US007292253B2

(12) United States Patent
Asai et al.

(10) Patent No.: US 7,292,253 B2
(45) Date of Patent: Nov. 6, 2007

(54) DISPLAY APPARATUS, INFORMATION DISPLAY METHOD, INFORMATION DISPLAY PROGRAM, READABLE RECORDING MEDIUM, AND INFORMATION APPARATUS

(75) Inventors: Yoshimi Asai, Osaka (JP); Noriyuki Koyama, Kyoto (JP); Satoshi Okada, Kyoto (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 127 days.

(21) Appl. No.: 10/510,549

(22) PCT Filed: Apr. 3, 2003

(86) PCT No.: PCT/JP03/04303

§ 371 (c)(1),
(2), (4) Date: Apr. 29, 2005

(87) PCT Pub. No.: WO03/085636

PCT Pub. Date: Oct. 16, 2003

(65) Prior Publication Data

US 2005/0219261 A1 Oct. 6, 2005

(30) Foreign Application Priority Data

Apr. 8, 2002 (JP) ..... 2002-105799

(51) Int. Cl.
*G09G 5/00* (2006.01)

(52) U.S. Cl. ..... 345/613

(58) Field of Classification Search ..... 345/613, 345/694–696, FOR. 168, 171; 382/299
See application file for complete search history.

(56) References Cited

U.S. PATENT DOCUMENTS

| | | | |
|---|---|---|---|
| 6,188,385 | B1 | 2/2001 | Hill et al. |
| 6,278,434 | B1 | 8/2001 | Hill et al. |
| 6,307,566 | B1 | 10/2001 | Hill et al. |
| 6,339,426 | B1 | 1/2002 | Lui et al. |
| 6,342,890 | B1 | 1/2002 | Shetter |
| 6,342,896 | B1 | 1/2002 | Shetter et al. |

(Continued)

FOREIGN PATENT DOCUMENTS

EP 1026659 A2 8/2000

(Continued)

OTHER PUBLICATIONS

"How sub-pixel font rendering works". [online]. Gibson Research Corporation, Feb. 11, 2002, [retrieved on May 21, 2003], Retrieved from the Internet: <URL: http://grc.com/ctwhat.htm>.

(Continued)

*Primary Examiner*—Matthew C. Bella
*Assistant Examiner*—Greg F. Cunningham
(74) *Attorney, Agent, or Firm*—Birch, Stewart, Kolasch & Birch, LLP

(57) ABSTRACT

A display apparatus (1) comprises a display device (10) and a control section (40) for displaying characters by using sub-pixel rendering. Each character is displayed in a frame having a predetermined size. The control section (40) has a skeleton portion shifting section (41*a*) which shifts a center of a skeleton portion of a character toward a center of the frame using sub-pixel precision.

19 Claims, 24 Drawing Sheets

U.S. PATENT DOCUMENTS

| | | | | |
|---|---|---|---|---|
| 6,421,054 | B1 | 7/2002 | Hill et al. | |
| 6,542,161 | B1 * | 4/2003 | Koyama et al. | 345/589 |

FOREIGN PATENT DOCUMENTS

| | | | |
|---|---|---|---|
| EP | 1111579 | A2 | 6/2001 |
| EP | 1158485 | A2 | 11/2001 |
| EP | 1174854 | A2 | 1/2002 |
| EP | 1174855 | A2 | 1/2002 |
| EP | 1225560 | A2 | 7/2002 |
| EP | 1271466 | A2 | 1/2003 |
| EP | 1284471 | A2 | 2/2003 |
| EP | 1308924 | A2 | 5/2003 |
| JP | 2001-100725 | A | 4/2001 |
| JP | 2001-184051 | A | 7/2001 |
| JP | 2002-049366 | A | 2/2002 |
| JP | 2002-099239 | A | 4/2002 |
| JP | 2002-287687 | A | 10/2002 |
| JP | 2003-005738 | A | 1/2003 |
| WO | WO-01/09873 | A1 | 2/2001 |
| WO | WO-01/78053 | A2 | 10/2001 |

OTHER PUBLICATIONS

"Sub-pixel rendering implementation details". [online]. Gibson Research Corporation, Dec. 8, 1999, [retrieved on May 21, 2003], Retrieved from the Internet: <URL: http://grc.com/cttech.htm>.

"ClearType—what is ClearType?". [online]. Microsoft Corporation, Jan. 16, 2002, [retrieved on May 21, 2003], Retrieved from the Internet: <URL: http://www.microsoft.com/typography/cleartype/what.htm>.

* cited by examiner

*FIG. 3*

Correction table 32b

| | | Correction pattern |
|---|---|---|
| Color factor level | Subpixel 1 | 5 |
| | Subpixel 2 | 2 |
| | Subpixel 3 | 1 |

*FIG. 4*

Luminance table 32c

| | | Luminance level | | |
|---|---|---|---|---|
| | | R | G | B |
| Color factor level | 7 | 0 | 0 | 0 |
| | 6 | 36 | 36 | 36 |
| | 5 | 73 | 73 | 73 |
| | 4 | 109 | 109 | 109 |
| | 3 | 146 | 146 | 146 |
| | 2 | 182 | 182 | 182 |
| | 1 | 219 | 219 | 219 |
| | 0 | 255 | 255 | 255 |

*FIG. 5A*

Shift table 321d

| | Device characteristic A | Device characteristic B | Device characteristic C | .... |
|---|---|---|---|---|
| Shift amount | 2 | 0 | 1 | .... |

*FIG. 5B*

Shift table 322d

| | Thickness width 1 | Thickness width 2 | Thickness width 3 | .... |
|---|---|---|---|---|
| Shift amount | 0 | 0 | 1 | .... |

*FIG. 5C*

Shift table 323d

| | European character | Kanji character | Non-Kanji character | .... |
|---|---|---|---|---|
| Shift amount | 0 | 2 | 1 | .... |

*FIG. 5D*

Shift table 324d

| Background \ Character or graphics | White | Black | Blue | Red | Yellow | ... |
|---|---|---|---|---|---|---|
| White | | 0 | 0 | 0 | 1 | |
| Black | 0 | | 1 | 1 | 2 | |
| Blue | 2 | 1 | | 0 | 2 | |
| Red | 1 | 2 | 0 | | 0 | |
| ⋮ | 1 | 2 | 2 | 1 | | |
| | | | | | | |

*FIG. 5E*

Shift table 325d

| Thickness width \ Device characteristic | A | B | C | D | ... |
|---|---|---|---|---|---|
| 1 | | 0 | 1 | 0 | |
| 2 | 2 | | 1 | 1 | |
| 3 | 0 | 1 | | 0 | |
| 4 | 1 | 2 | 0 | | |
| ⋮ | | | | | |

1802
X
Y
1 2 5 7 5 2 1
1 2 5 7 5 2
1 2 5 7 7 7

X
Y
1803
1802
2 5 7 5 2 1
1 2 5 7 5 2 1
2 5 7 7 7 7
7 7 7 7 7 7
7 7 7 7 7 7
7 7

DISPLAY APPARATUS, INFORMATION DISPLAY METHOD, INFORMATION DISPLAY PROGRAM, READABLE RECORDING MEDIUM, AND INFORMATION APPARATUS

TECHNICAL FIELD

The present invention relates to a display apparatus, information display method, information display program, and readable recording medium for displaying information and the like using a display device capable of color display, and an information apparatus incorporating the same.

BACKGROUND ART

A conventional display apparatus for displaying characters and the like using a display device capable of color display is disclosed in, for example, Japanese Laid-Open Publication No. 2001-100725.

In this conventional technique, the intensities (e.g., luminance level) of the color factors of subpixels corresponding to the basic portion of a character are assigned a predetermined value, while the intensities of the color factors of subpixels neighboring the subpixels corresponding to the basic portion are assigned values other than the predetermined value. The number of the neighboring subpixels having the intensities of the color factors other than the predetermined value and the intensity of the color factor of each subpixel are determined based on a correction pattern. Note that the basic portion of a character refers to a core portion of the character.

For example, FIGS. 13 and 14 show a conventional technique disclosed in Japanese Laid-Open Publication No. 2001-100725.

Referring to FIG. 13, the intensity of each color factor corresponding to the basic portion (skeleton portion) of character "/" (slash) is assigned a predetermined value.

In FIG. 13, hatched rectangles indicate subpixels corresponding to the basic portion (skeleton portion) of character "/". When the intensity of the color factor of each subpixel is represented as a luminance level of 0 to 255, the intensity of the color factor of each subpixel corresponding to the basic portion (skeleton portion) of character "/" (slash) is assigned, for example, "luminance level 0" (predetermined value).

In FIG. 13, open rectangles indicate subpixels corresponding to the background of the basic portion of the character "/". The intensity of the color factor of each subpixel corresponding to the background of the basic portion of character "/" is assigned, for example, luminance level 255.

Referring to FIG. 14, the intensities of the color factors of subpixels neighboring the subpixels corresponding to character "/" are assigned values other than the predetermined value.

In FIG. 14, the intensities of the color factors of three neighboring subpixels on each lateral side of a specific subpixel corresponding to the basic portion "/" constituting the displayed character are assigned "luminance level 73", "luminance level 182", and "luminance level 219" in order of distance from the basic portion, the nearest first, in accordance with a predetermined correction pattern. Note that "assign luminance levels to the intensities of the color factors of subpixels neighboring a specific subpixel corresponding to the basic portion of a displayed character in accordance with a correction pattern" is referred to as "dispose a correction pattern".

The purposes of disposition of a correction pattern include: suppression of color noise; recognition of characters or graphics as being black for human eyes; and adjustment of the thickness of characters to a desired size.

Thus, according to the conventional technique of Japanese Laid-Open Publication No. 2001-100725, characters can be displayed with high definition by disposing the correction pattern neighboring subpixels corresponding to the basic portion of a character.

Further, according to the conventional technique of Japanese Laid-Open Publication No. 2001-100725, subpixels corresponding to the basic portion are determined based on character outline information indicating the outlines of characters or skeleton data indicating the skeleton shapes of characters.

For example, the character outline information includes a character code for identifying the type of a character, the number of strokes constituting a character (the stroke count of a character), and stroke information on each stroke. The stroke information includes a stroke code for identifying a stroke, the number of contour points constituting a stroke, and a pointer to the coordinate data of contour points constituting a stroke (an address in an auxiliary storage device at which the coordinates of the contour points constituting the stroke are stored). From this information, the coordinates of the contour points constituting a stroke can be obtained. In this case, each stroke has a shape enclosed by a contour line approximated by curved lines, straight lines, arcs, a combination thereof, or the like, and a predetermined thickness so as to display the contour shape of a character.

A contour line representing the contour shape of a character can be approximated by straight lines, curved lines, arcs, a combination thereof, or the like, using the coordinate data of contour points. The contour line is scaled in accordance with the size of an input character. This scaling converts the coordinate data of contour points to a coordinate system for a display device.

A sub-pixel is determined to correspond to a basic portion representing the skeleton of a character depending on an area where a region enclosed by a contour line overlaps a sub-pixel, for example, if the area is greater than or equal to a predetermined area.

Skeleton data includes a character code for identifying the type of a character, the number of strokes constituting a character, and stroke information on each stroke. The stroke information includes a stroke number for identifying a stroke, the number of points constituting a stroke, the line type of a stroke (curved line, straight line, or the like), the coordinates of points constituting a stroke, and the like. In this case, each stroke does not have a thickness, and each stroke is in the form of a line of a certain line type for representing the skeletal shape of a character.

If the line type of a stroke is a straight line, the stroke can be approximated by a straight line passing through a plurality of points constituting the stroke using the coordinate data. If the line type of a stroke is a curved line, the stroke can be approximated by a curved line passing through a plurality of points constituting the stroke using the coordinate data. The coordinate data of points constituting each stroke is scaled in accordance with the size of an input character and is converted into a coordinate system for a display device.

Subpixels present on each scaled stroke are determined as subpixels corresponding to a basic portion representing the skeleton of a character.

The applicant of the present application proposed a technique for corresponding to a basic portion of graphics to subpixels using bitmap data as disclosed in Japanese Laid-Open Publication No. 2002-49366. This technique will be described in detail below.

Typically, bitmap data is binary data (binary is an example). Each of bits constituting bitmap data has a value of "1" or "0". A bit having a value of "1" indicates, for example, a black portion of graphics, while a bit having a value of "0" indicates a white portion of graphics.

It is determined whether or not each of bits constituting bitmap data has a value of "1". An arrangement pattern of "1"/"0" values of bits neighboring a bit of interest is investigated. The bit of interest is associated with a pixel of a display device. Based on the arrangement pattern of neighboring bits, a subpixel(s) corresponding to the basic portion is determined among the subpixels contained in a pixel corresponding to the bit of interest.

FIG. 15 is a diagram showing a part of bitmap data representing graphics.

D(x, y) represents a bit of interest, and N(a, b) represents a bit D(x+a, y+b) neighboring D(x, y). FIG. 15 shows one bit D(x, y) and 8 vertically, horizontally or diagonally neighboring bits N(−1, 1), N(0, −1), N(1, −1), N(−1, 0), N(1, 0), N(−1, 1), N(0, 1) and N(1, 1). These eight neighboring bits are referred to as 8 neighbors. N(a, b) and D(x, y) each have a value of "1" or "0".

FIG. 16 is a diagram showing a part of a display screen of a display device.

P(x, y) represents a pixel on the display screen. Bit D(x, y) shown in FIG. 15 is associated with pixel P(x, y) when graphics represented by bitmap data is displayed by the display device. Pixel P(x, y) contains three subpixels C(3x, y), C(3x+1, y) and C(3x+2, y).

When D(x, y) has a value of "1", a subpixel(s) corresponding to the basic portion is determined among three subpixels C(3x, y), C(3x+1, y) and C(3x+2, y) in accordance with a basic portion definition rule. When D(x, y) has a value of "0", none of the three subpixels is determined as a subpixel corresponding to the basic portion.

Note bit D(x, y) of FIG. 15 is herein associated with a plurality of subpixels of FIG. 16, i.e., pixel P(x, y) containing a group of C(3x, y), C(3x+1, y) and C(3x+2, y). Alternatively, bit D(x, y) may be associated with a subpixel group Grp shown in FIG. 16. Note that the number of subpixels in the group may not be necessarily equal to the number of subpixels in a pixel. For example, bit D(x, y) may be associated with a group Grp' of 4 subpixels of FIG. 16. Furthermore, the direction of subpixels being arranged is not limited to the X direction. For example, bit D(x, y) may be associated with a group Grp" of subpixels arranged in the X and Y directions of FIG. 16.

According to the basic portion definition rule, whether or not each of three subpixels in pixel P(x, y) is associated with a basic portion is determined based on the "0"/"1" arrangement of bit N(a, b) neighboring bit D (x, y) associated with pixel P(x, y). Hereinafter, it is assumed that bit D(x, y) has a value of "1".

FIG. 17A is a diagram showing exemplary 8 neighboring bits for bit D(x, y) of interest in bitmap data.

By N(a, b)=1 it is intended that bit N(a, b) has a value of "1", and by N(a, b)=0 it is intended that N(a, b) has a value of "0". In this case, in FIG. 17A, N(0, −1)=N(1, 1)=1, N(1, 0)=N(0, 1)=N(−1, 1)=N(−1, 0)=0, and N(−1, −1) and N(1, −1) indicated by "#" has a value of either "0" or "1".

FIG. 17B is a diagram showing a subpixel associated with a basic portion in accordance with the basic portion definition rule, where the 8 neighboring bits for bit D(x, y) has values as shown in FIG. 17A.

Pixel P(x, y) on a display screen corresponding to bit D(x, y) contains three subpixels C(3x, y), C(3x+1, y) and C(3x+2, y). Among these subpixels, a subpixel indicated by "1" is associated with a basic portion, while subpixels indicated by "0" is not associated with a basic portion. In other words, subpixel C(3x+2, y) is associated with a basic portion, while C(3x, y) and C(3x+1, y) are not associated with a basic portion.

The basic portion definition rule described with reference to FIGS. 17A and 17B can be represented by a logical formula.

For logical values A and B, it is assumed that "A*B" means logical multiplication of A and B and "!A" is logical negation of A. When the 8 neighboring bits for bit D(x, y) have values shown in FIG. 17A, the following logical formula (1) is satisfied.

$$N(0,-1)*!N(-1,0)*!N(1,0)*!N(-1,1)*!N(0,1)*N(1,1)=1 \quad (1)$$

As shown in FIG. 17B, the following formula (2) represents the process that subpixel C(3x+2, y) is defined as a basic portion, while subpixel C(3x, y) and subpixel C(3x+1, y) are not defined as a basic portion.

$$C(3x, y)=0,$$

$$C(3x+1, y)=0, \text{ and}$$

$$C(3x+2, y)=1 \quad (2)$$

A basic portion is a portion of a character or graphics corresponding to a core thereof. The core is a central portion of a stroke contained in a character, for example. Stroke information is dropped from bitmap data. Therefore, a bit in the bitmap data is associated with a basic portion with inference. A basic portion can be inferred based on information on bits neighboring bit D(x, y) of interest, but not based on only information on bit D(x, y) of interest.

For example, in the bitmap data of FIG. 17A, a stroke is inferred to be a curved line (dashed line 1301 in FIG. 17A) which passes through areas corresponding to bits N(0, −1), D(x, y), and N(1, 1). Such a curved line is considered to pass through the right-hand side of an area corresponding to bit D(x, y). Therefore, in FIG. 17B, sub-pixel C(3x+2, y) on the right-hand side of pixel P(x, y) corresponding to bit D(x, y) is associated with a basic portion. Based on such inference, a basic portion definition rule is generated.

Basic portions are defined in subpixels. Therefore, the basic portion of graphics can be defined with a resolution higher than the pixel-by-pixel resolution, resulting in high definition graphics display.

FIG. 18A is a diagram showing another exemplary set of 8 neighbors for bit D(x, y) of interest in bitmap data. FIG. 18B is a diagram showing subpixels defined in accordance with the basic portion definition rule when the 8 neighboring bit for bit D(x, y) has values shown in FIG. 18A.

The basic portion definition rule shown in FIGS. 18A and 18B is represented by the following logical formula.

$$\text{When } N(-1,0)*N(1,0)=1,$$

$$C(3x, y)=1,$$

$$C(3x+1, y)=1, \text{ and}$$

$$C(3x+2, y)=1.$$

FIG. 19A is a diagram showing another exemplary set for 8 neighbors of bit D(x, y) of interest in bitmap data. FIG. 19B is a diagram showing subpixels defined in accordance with the basic portion definition rule when the 8 neighboring bit for bit D(x, y) has values shown in FIG. 19A.

The basic portion definition rule shown in FIGS. 19A and 19B is represented by the following logical formula.

When $N(0, -1)*!N(-1, 0)*!N(1, 0)*N(0, 1)=1$, $C(3x, y)=0$, $C(3x+1, y)=1$, and $C(3x+2, y)=0$.

Similarly, basic portion definition rules are established for all combinations of "1" or "0" of the 8 neighboring bits for bit D(x, y) of interest. As a result, basic portions of graphics to be displayed by a display device are defined in subpixels.

FIG. 20 is a diagram showing all combinations of "1" or "0" of the 8 neighboring bits.

Each rectangle shown in FIG. 20 represents a set of bit D(x, y) of interest and its 8 neighboring bits. The rectangle is divided into nine regions. A region indicated by black corresponds to a bit having a value of "1", while a region indicated by white corresponds to a bit having a value of "0". 256 rectangles are shown in FIG. 20. Each of the 8 neighboring bits has a value of "0" or "1", so that the number of combinations is $2^8$ (=256).

However, the number of basic portion definition rules required is not necessarily equal to the number of possible combinations. As described above, in FIGS. 17A, 18A and 19A, bits indicated by "#" have any value of "0" or "1" so that these bits are not taken into account in basic portion definition rules. Since there are some bits which are not taken into account in basic portion definition rules, a certain single basic portion definition rule can cover a plurality of combinations of FIG. 20. For example, the basic portion definition rule of FIGS. 17A and 17B covers combinations indicated by a rectangle 1701, a rectangle 1702, a rectangle 1703 and a rectangle 1704 of FIG. 20. Thus, since all or part of basic portion definition rules may contain a bit(s) having an arbitrary value, the number of basic portion definition rules required can be reduced.

Note that basic portion definition rules may be represented by logical formulas or table data.

A character or graphics is contained within a frame having a predetermined size. Subpixels corresponding to the basic portion of a character or graphics are contained in the inside of a region corresponding to the frame in the display screen region of a display device. A frame is a region in which a single character or graphics is displayed, for example, a region enclosed by a thick line 1901.

Characters represented by pixel-unit bitmap data are generally designed so that open space is provided either on the right-hand or left-hand side of a frame, i.e., characters are spaced. For example, in FIG. 21, character "H" is disposed in a frame, leaving 1 bit space on the left-hand side.

FIG. 22 is a diagram showing an example in which subpixels corresponding to the basic portion are determined from character "H" of FIG. 21 using the conventional technique disclosed in Japanese Laid-Open Publication No. 2002-49366 (supra). In accordance with the above-described basic portion definition rule, a stroke 1801 extending in the X direction of FIG. 22 is shown as a continuous skeleton shape.

In FIG. 23, the conventional technique disclosed in Japanese Laid-Open Publication No. 2001-100725 (supra) is used to assign a predetermined value to the intensities of the color factors of subpixels corresponding to the basic portion of character "H" of FIG. 22, and the intensities of the color factors of subpixels neighboring subpixels corresponding to the basic portion of character "H" to values other than the predetermined value.

In FIG. 23, the luminance level of the subpixels corresponding to the basic portion of character "H" is assigned "0"; the luminance levels of three laterally neighboring subpixels are assigned "73", "182" and "219" in order of distance; and the luminance level of subpixels corresponding to the background is assigned 255.

In the example of FIG. 23, three subpixels are required for disposition of a correction pattern. However, in a region 1021 corresponding to a frame containing character "H", only a subpixel is present on the right-hand side of subpixels 1051 corresponding to the basic portion of character "H". Therefore, for a part (portion 1041) of the right-hand vertical line of character "H", the correction pattern cannot be disposed in a manner that enables the correction pattern to be put within the region 1021 of the frame for character "H".

A character is displayed on a display device in a manner that enables the character to be put within a region of a display screen corresponding to the frame of the character. Therefore, when the correction pattern cannot be put within the region 1021 as shown in FIG. 23, color noise occurs around the portion 1041, or the line of the character is not perceived as having a desired thickness. In this case, the right-hand vertical line of character "H" is perceived as being thinner than the left-hand vertical line of character "H". For this reason, character "H" is not displayed on a display device with high definition.

Thus, the correction pattern for characters cannot be disposed in a manner that enables the correction pattern to be put within a region corresponding to the frame of the character. Therefore, characters are not displayed with high definition. To solve the above-described problems, the present applicant proposed a method for disposing a part of a correction pattern of a frame for a first character in a frame for a second character in Japanese Laid-Open Publication No. 2003-5738.

FIG. 24 is a diagram showing an example in with a conventional technique of Japanese Laid-Open Publication No. 2003-5738, in order to dispose the correction pattern for a first character (character "H"), a part (portion 1061) of a frame for a second character (character "A") is used.

The width of the first character (character "H") is 15*a* and the width of the second character (character "A") is 15*b*.

However, in the conventional technique disclosed in Japanese Laid-Open Publication No. 2003-5738 (supra), a correction pattern is disposed by taking into account contact or overlap between a correction pattern for character "H" and character "A". Such a process is complicated and therefore it takes a long time to perform such a process.

The present invention is provided to solve the above-described conventional problems. An object of the present invention is to provide a display apparatus, information display method, information display program and readable recording medium capable of displaying information with high definition is provided, in which when a correction pattern cannot be disposed in a manner that enable information to be put within a frame region, the correction pattern is shifted in a simple manner so that color noise is reduced. Another object of the present invention is to provide an information apparatus incorporating the above-described display apparatus, information display method, information display program, or readable recording medium.

DISCLOSURE OF THE INVENTION

According to an aspect of the present invention, a display apparatus comprises a control section for controlling display on a display screen so that portions neighboring a skeleton portion of symbol information (e.g., character or graphics information) are assigned color factor levels. The character or graphics information is displayed in frames having a predetermined size and the color factor levels are stepwise lower than a color factor level of the skeleton portion. The control section has a skeleton portion shifting section capable of controlling shift of a center of the skeleton portion toward a center of the frame in a predetermined direction (either the X direction or the Y direction) on the display screen. Thereby, the above-described objects can be achieved.

Preferably, the control section may comprise a skeleton portion color factor level assigning section for assigning a predetermined color factor level to a subpixel corresponding to the skeleton portion of the symbol information after the skeleton portion has been shifted, an outside color factor level assigning section for assigning at least one color factor level stepwise lower than the predetermined color factor level of the subpixel corresponding to the skeleton portion to at least one neighboring subpixel outside the skeleton portion, and a display control section for displaying the symbol information assigned the color factor levels on the display screen.

Preferably, in the display apparatus of the present invention, a plurality of pixels are provided on the display screen, each pixel having a plurality of subpixels arranged in a predetermined direction, and the control section (e.g., the skeleton portion shifting section) is capable of shifting the skeleton portion of the character or graphics information in a subpixel arrangement direction within the frame on a subpixel-by-subpixel basis. In the display apparatus of the present invention, each pixel is previously assigned a corresponding one of a plurality of color factors. The luminance levels of the color factors are represented stepwise by a plurality of color factor levels. Thereby, characters or graphics are controlled and displayed on a display screen.

More preferably, the control section is capable of shifting the skeleton portion of the frame so that at least two subpixels having a color factor level lower than the color factor level of the skeleton portion are disposed inwardly from an end of the frame.

The symbol information may be at least one of character information, graphics information, picture character information, and sign information.

Preferably, the skeleton portion of the character or graphics information may be defined by bitmap data.

Preferably, the skeleton portion of the character or graphics information may be defined in subpixels.

Preferably, the control section may be capable of shifting the skeleton portion of the character or graphics information in a subpixel arrangement direction within the frame by one or two pixels. Alternatively, the control section may be capable of shifting the skeleton portion of the character or graphics information in a subpixel arrangement direction within the frame by three pixels or more.

Preferably, the display apparatus may have a shift table storing shift information for defining a shift amount of the skeleton portion of the character or graphics information, and the control section may be capable of determining the shift amount of the skeleton by referencing the shift table.

Preferably, the display apparatus may have a plurality of shift tables, and the control section is capable of changing the shift amount of the skeleton by selecting and referencing at least one of the plurality of shift tables.

Preferably, the display apparatus may have a recording section for storing information on a result of shifting the skeleton portion in the subpixel arrangement direction within the frame on a subpixel-by-subpixel basis.

According to another aspect of the present invention, a character/graphics display method for controlling and displaying character or graphics information on a display screen is provided. A plurality of pixels are provided in a frame having a predetermined size on the display screen, each pixel contains a plurality of subpixels arranged in a predetermined direction, and at least one subpixel outside a skeleton portion of the character or graphics information is assigned a dolor factor level stepwise lower than a color factor level. The method comprises the steps of: shifting the skeleton portion of the character or graphics information in a subpixel arrangment direction within the frame on a subpixel-by-subpixel basis; and assigning a predetermined color factor level to a subpixel corresponding to the skeleton portion of the character or graphics information, and assigning at least one color factor level stepwise lower than the predetermined color factor level of the subpixel corresponding to the skeleton portion to at least one neighboring subpixel outside the skeleton portion. Thereby, the above-described objects can be achieved.

According to another aspect of the present invention, a character/graphics display program executable in a computer is provided. The above-described character/graphics display method is described in the program.

According to another aspect of the present invention, a computer readable recording medium is provided. The above-described character/graphics display program is recorded in the medium.

According to another aspect of the present invention, an information apparatus is provided, which comprises the above-described display apparatus.

Hereinafter, functions of the present invention will be described.

According to the present invention, a subpixel corresponding to the skeleton portion (basic portion) of character or graphics information is assigned a predetermined color factor level. Neighboring subpixels outside that subpixel are assigned color factor levels stepwise lower than the predetermined color factor level (i.e., a correction pattern is disposed). In this case, if the correction pattern cannot be put within a region corresponding to a frame on the display screen of a display apparatus, the center of the skeleton portion of the character or graphics information is shifted to the center of the frame. Specifically, character or graphics information is shifted within the frame in a subpixel arrangement direction on a subpixel-by-subpixel basis. The skeleton portion (basic portion) may be shifted so that a correction pattern having at least two subpixels (having color factor levels stepwise lower than a predetermined color factor level) can be provided inwardly from an end of the frame. Therefore, a correction pattern extending off a region corresponding to the frame can be shifted deeper into the region corresponding to the frame (the correction pattern may not be shifted completely inside the region), whereby color noise is suppressed and the thickness of a line of a character can be adjusted so that character or graphics information can be displayed with high definition.

The skeleton portion of character or graphics information can be defined as bitmap data in subpixels (basic portion data). This skeleton portion data (basic portion data) may be generated in pixels from, for example, bitmap data representing the shape of character or graphics information, outline information representing the outline shape of character or graphics information, or skeleton data representing the skeleton shape of character or graphics information.

Particularly in the case of pixel-unit bitmap data, characters or graphics are often designed such that either the right-hand side or the left-hand side of each character or graphics has open space. In this case, a correction pattern often extends off the frame at its end. The present invention can solve such a problem.

The skeleton portion (basic portion) of character or graphics information is defined in subpixels. Therefore, characters or graphics can be precisely controlled and displayed with high definition as compared to when color factor levels are controlled on a pixel-by-pixel basis.

The skeleton portion of character or graphics information is shifted by 1 or 2 subpixels deeper into the frame in a subpixel arrangement direction. In this case, the shift amount can be precisely and carefully determined, by referencing a shift table defining shift amounts, based on various display conditions, such as the characteristics of a display device, the thickness of a line of a character or graphics, the type of a character, a combination of a background color and a character or graphics color, and the like.

Further, the result of shifting the skeleton portion (basic portion) of character or graphics information deeper into the frame in the subpixel arrangement direction on a subpixel-by-subpixel basis is stored as data. Such data can be utilized when the same character or graphics information is displayed on another display apparatus.

These and other advantages of the present invention will become apparent to those skilled in the art upon reading and understanding the following detailed description with reference to the accompanying figures.

BRIEF DESCRIPTION OF THE DRAWINGS

FIG. 3 is a diagram showing an exemplary correction table stored in an auxiliary storage device of FIG. 1.

FIG. 4 is a diagram showing an exemplary luminance table stored in the auxiliary storage device of FIG. 1.

FIGS. 5A to 5E are diagrams showing exemplary shift tables stored in the auxiliary storage device of FIG. 1.

BEST MODE FOR CARRYING OUT THE INVENTION

Hereinafter, the present invention will be described by way of illustrative examples with reference to the accompanying drawings.

Figure 1:
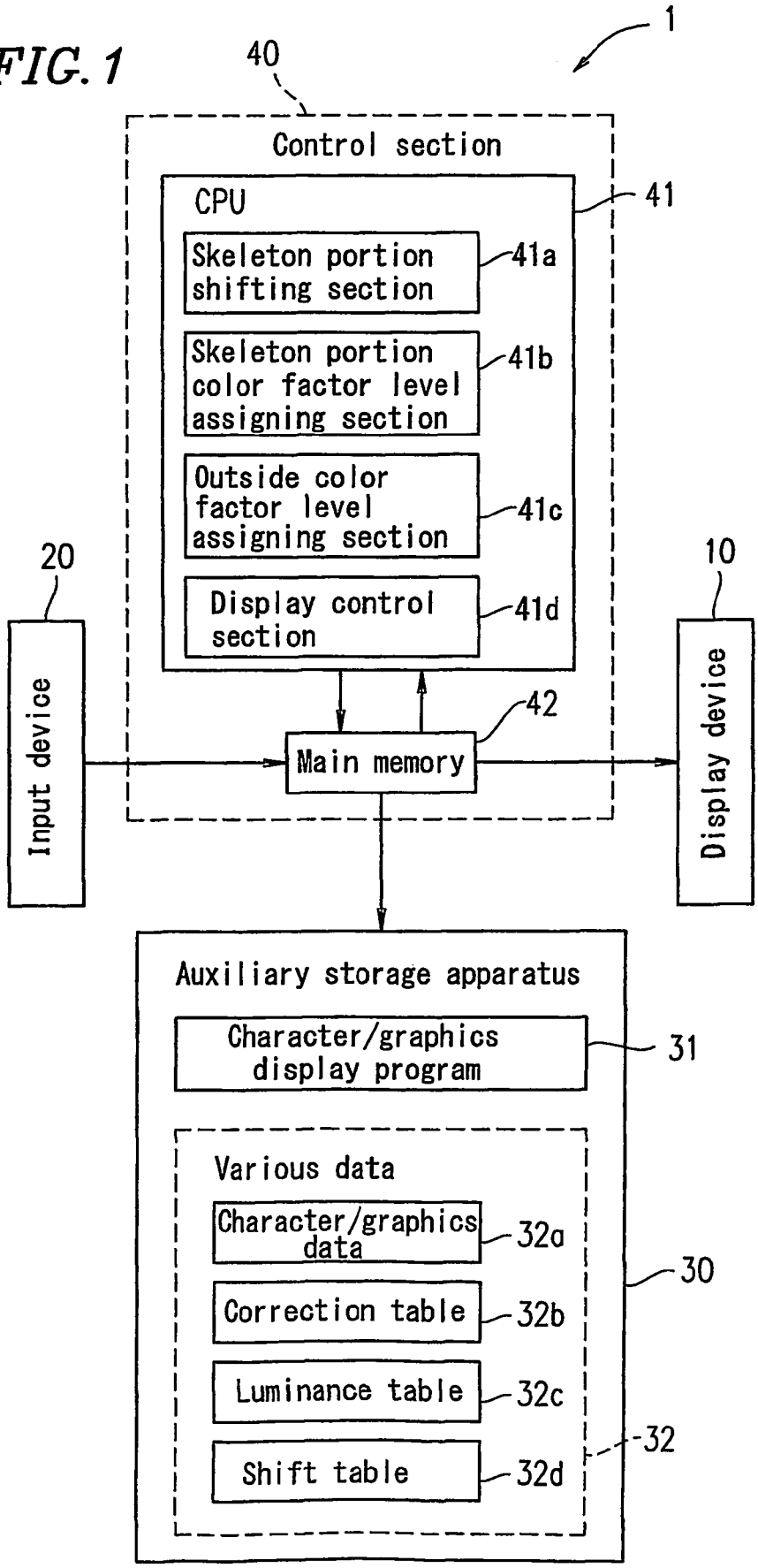
FIG. 1 is a block diagram showing a configuration of a display apparatus according to an embodiment of the present invention.
Figure 25:
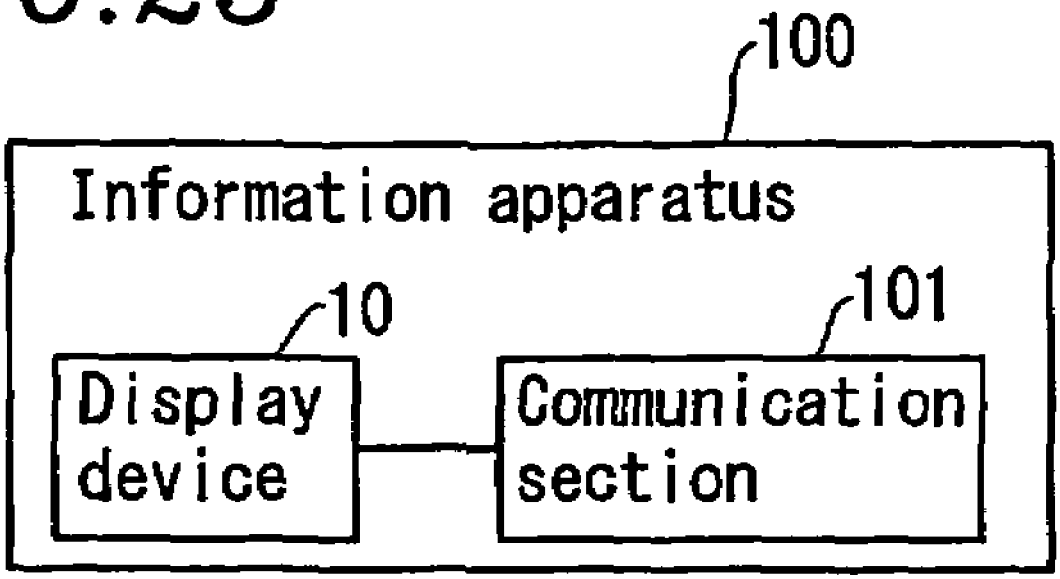
FIG. 25 is a diagram showing an information apparatus according to the present invention.

FIG. 1 is a block diagram showing a configuration of a display apparatus according to an embodiment of the present invention. In FIG. 1, the display apparatus 1 comprises a display device 10 capable of color display, an input device 20 capable of inputting various information representing characters, graphics or the like, an auxiliary storage device 30 storing a control program and various data, and a control section 40 for controlling the display device 10 to display information input through the input device 20 based on the control program and various data. The display apparatus of the present invention may be used as a display section of display apparatus, such as personal computers, word processors, and the like, and may have various types, such as desktop, laptop, and the like. Alternatively, the display apparatus of the present invention may be used as a display section (display apparatus) of any information apparatus (as indicated by reference numeral 100 in FIG. 25), such as electronic apparatus incorporating a display device capable of color display. For example, the information apparatus 1 of the present invention may have a communication section (as indicated by reference numeral 101 in FIG. 25) capable of communicating with the outside and may be used as a display section of mobile information instruments (e.g., personal digital assistants and the like), mobile telephones (e.g., PHS and the like), and communication apparatus (e.g., typical telephones/FAX and the like).

The display device 10 displays various information, such as characters, graphics, and the like, input through the input device 20.

The input device 20 is used to input various information representing characters or graphics to be displayed on the display device 10. The various information representing characters or graphics include, for example, a code for identifying a character or graphics and a size indicating the size of a character or graphics. Therefore, as the input device 20, any input device through which an identification code and the size of a character or graphics can be input can be used. Preferable examples of the input device 20 include keyboards, mouses, pen-type input devices, and the like. When the display apparatus 1 is a display apparatus of a mobile telephone, voice or number keys for specifying telephone numbers may be used as the input device 20 to enter character codes and character sizes. When characters or graphics displayed on the display device 10 have a single fixed size, the input of the size may be omitted. Further, when the display apparatus 1 is used as a display section of an information apparatus provided with means for connecting to a communication line, such as the Internet and the like, messages included in electronic mail received over the communication line may be displayed on the display device 10. In this case, the communication line connecting means may be operated by inputs through the input device 20.

In the auxiliary storage device 30, a character/graphics display program 31 as a control program, in which a procedure for displaying characters or graphics on a display screen of the display device 10 is described, and various data 32 required for executing the character/graphics display program 31 are stored. In the auxiliary storage device 30, any readable recording medium may be used to store the character/graphics display program 31 and the various data 32, including, for example, recording media, such as hard disk, CD-ROM, MO, MD, DVD, IC card, optical card, flash memory, and the like.

The character/graphics display program 31 comprises the steps of: shifting a skeleton portion of character or graphics information in a subpixel arrangement direction within a frame having predetermined size on a subpixel-by-subpixel basis; and assigning a predetermined color factor level to the color factor level of a subpixel corresponding to the skeleton portion of the character or graphics information and assigning color factor levels stepwise lower than the predetermined color factor level to the respective color factor levels of subpixels neighboring the subpixel corresponding to the skeleton portion (neighboring subpixels on the outside of the subpixel corresponding to the skeleton portion), and displaying the character or graphics information on a display screen.

The various data 32 contain various table data, such as character/graphics data 32*a* defining shapes of characters or graphics, a correction table 32*b* described below in detail (FIG. 3), a luminance table 32*c* (FIG. 4), a shift table 32*d* (FIGS. 5A to 5E), and the like.

The character/graphics data 32*a* include, for example, bitmap data (basic portion data) defining basic portions of characters or graphics in subpixels. A basic portion of a character or graphics refers to a portion of the character or graphics corresponding to the core thereof.

The control section 40 comprises a CPU 41 and a main memory 42. The control section 40 determines the intensities of the color factors of subpixels contained in a display screen of the display device 10 and controls the display device 10 to display characters or graphics on the display screen, based on the display character/graphics display program 31 and the various data 32. Specifically, the control section 40 controls separately a plurality of color factors assigned to a plurality of subpixels arranged on the display screen of the display device 10 to display information representing characters or graphics input through the input device 20 on the display device 10.

The CPU 41 controls and monitors the whole display apparatus 1 as well as executes the character/graphics display program 31 stored in the auxiliary storage device 30. The CPU 41 executes the character/graphics display program 31 based on the various data 32 stored in the main memory 42 to generate character or graphics patterns. The generated patterns are temporarily stored in the main memory 42, and thereafter, are output as display data to the display device 10. The timing of outputting character or graphics patterns to the display device 10 is controlled by the CPU 41.

The CPU 41 comprises a skeleton portion shifting section 41*a* for subjecting a skeleton portion of character or graphics information to a shift process which is performed in a subpixel arrangement direction within a frame having predetermined size on a subpixel-by-subpixel basis; a skeleton portion color factor level assigning section 41*b* for assigning a predetermined color factor level to the color factor level of a subpixel corresponding to the skeleton portion of the character or graphics information after the shift process; an outside color factor level assigning section 41*c* for assigning color factor levels stepwise lower than the predetermined color factor level to the respective color factor levels of subpixels neighboring the subpixel corresponding to the skeleton portion assigned the color factor levels (neighboring subpixels on the outside of the subpixel corresponding to the skeleton portion); and a display control section 41*d* for displaying the character or graphics information assigned the color factor levels on a display screen.

The main memory 42 is a working memory for temporarily storing data input through the input device 20, data to be displayed on the display screen of the display device 10, and the character/graphics display program 31 and data required to execute the program 31. The main memory 42 may be accessed by the CPU 41 at a high rate.

Note that the character/graphics display program 31 and the various data 32 are herein stored in the readable recording medium of the auxiliary storage device 30, and the present invention is not so limited. For example, the character/graphics display program 31 and the various data 32 may be stored in the main memory 42 or ROM (not shown). Examples of ROM include mask ROM, EPROM, EEPROM, flash ROM, and the like. When the character/graphics display program 31 and the various data 32 are stored in ROM, various processes can be easily achieved by changing ROM. Such a ROM technique may be preferably applied to the display apparatus 1 when it is a mobile terminal apparatus, a mobile telephone, or the like.

A readable recording medium for storing the character/graphics display program 31 and the various data 32 may be a medium for carrying programs or data, such as a communication medium used to carry programs or data over a communication network, other than media for fixedly carrying programs or data, such as storage devices (the above-described disks or cards), semiconductor memories, and the like. When the display apparatus 1 is an information apparatus provided with means for connecting a communication line including the Internet, at least part of the character/graphics display program 31 and the various data 32 may be downloaded from the communication line. In this case, a loader program required for download may be previously stored in ROM (not shown), or may be installed from the auxiliary storage device 30 to the control section 40.

Figure 2:
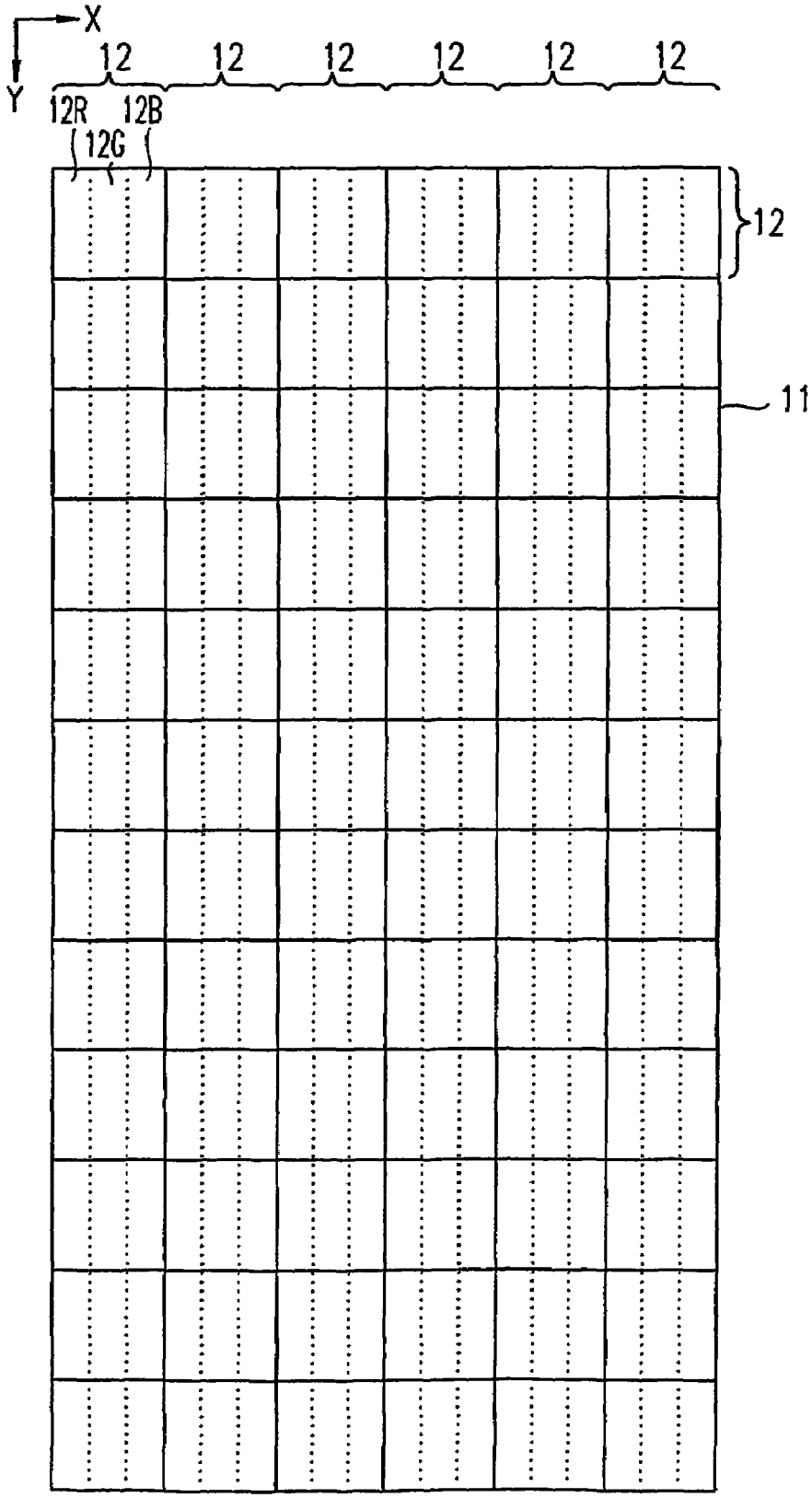
FIG. 2 is a schematic diagram showing an exemplary display screen of the display device of FIG. 1.

FIG. 2 is a schematic diagram showing an exemplary display screen of the display device 10 of FIG. 1. In FIG. 2, a display screen 11 of the display device 10 has a plurality of pixel 12 arranged in the X and Y directions. Each pixel 12 has a plurality of subpixels arranged in the X direction here indicated by 12R, 12G, and 12B.

The subpixel 12R is assigned a color factor R so as to exhibit a red (R) color. The subpixel 12G is assigned a color factor G so as to exhibit a green (G) color. The subpixel 12B is assigned a color factor B so as to exhibit a blue (B) color.

The intensities of the color factors (e.g., luminance levels) of the subpixels 12R, 12G, and 12B are represented by a value of, for example, 0 to 255 (0x00 to 0xff where notation "0x" represents the hexadecimal number system). If the subpixels 12R, 12G, and 12B separately take any luminance level of 0 to 255, about 16,700,000 (=256×256×256) colors can be displayed.

The display device 10 is, for example, a color liquid crystal display device. Examples of the color liquid crystal display device include transmissive liquid crystal display devices predominantly used for personal computers and the like, as well as reflective or rear-projection liquid crystal display devices. The display device 10 is not limited to color liquid crystal display devices. As the display device 10, any color display apparatus having a plurality of pixels arranged in the X and Y directions (so called XY matrix display apparatus) can be used.

The number of subpixels contained in a single pixel 12 is not limited to 3. A single pixel 12 may contain a plurality of subpixels arranged in a predetermined direction. For example, when N color factors are used to represent colors, a single pixel 12 may contain N subpixels.

The arrangement sequence of the subpixels 12R, 12G, and 12B is not limited to that shown in FIG. 2. For example, the sequence of B, G and R in this order in the X direction may be used instead of the sequence of R, G, and B in this order.

The direction of the arrangement of the subpixels 12R, 12G, and 12B is not limited to the direction shown in FIG. 2 (X direction). Alternatively, the subpixels 12R, 12G, and 12B may be arranged in the Y direction.

Color factors applicable to the present invention are not limited to red (R), green (G), and blue (B). For example, cyan (C), yellow (Y), and magenta (M) may be used as color factors.

FIG. 3 is a diagram showing an exemplary correction table 32*b* stored in the auxiliary storage device 30 of FIG. 1. In FIG. 3, the correction table 32*b* defines the intensities of the color factors (correction pattern) of subpixels neighboring a subpixel corresponding to the basic portion of a character or graphics. The correction pattern defined by the correction table 32*b* shows that the color factor levels of subpixels positioned on each side (X direction and/or −(minus) X direction) of a subpixel corresponding to the basic portion of a character or graphics are assigned "5", "2", and "1" in order of distance from the basic portion of a character or graphics, the nearest subpixel first. Hereinafter, for the sake of simplicity, the correction pattern is represented by list expression (5, 2, 1). The length (3 in this example) of the list defines the length of the correction pattern. A neighboring subpixel for a subpixel corresponding to the basic portion refers to a subpixel which is located in the X direction or −X direction relative to a subpixel corresponding to the basic portion and within a distance equal to the length of the correction pattern where the distance is defined by the number of subpixels counted in the X and −X directions from the subpixel corresponding to the basic portion to the neighboring pixel. Note that the correction table 32*b* of FIG. 1 is not limited to the correction table 32*b* of FIG. 3. The length of the correction pattern is not limited to "3".

Thus, a correction pattern is used to establish the color factor level of at least a subpixel neighboring a subpixel corresponding to the basic portion of a character or graphics. The color factor level is defined according to the distance from the subpixel corresponding to the basic portion of the character or graphics. For example, the color factor level of a subpixel neighboring a subpixel corresponding to the basic portion of a character or graphics is designed to be monotonically decreased as the distance from the subpixel corresponding to the basic portion of the character or graphics increases. The decreasing manner is not limited to the above-described (5, 2, 1).

FIG. 4 is an exemplary luminance table 32*c* stored in the auxiliary storage device 30 of FIG. 1. By storing the luminance table 32*c* in the auxiliary storage device 30, the color factor level of a subpixel can be easily converted to a luminance level. As shown in FIG. 4, in the luminance table 32*c*, 8 color factor levels (level 7 to level 0) of subpixels are substantially equally spaced in terms of luminance levels 0 to 255. Color factor level "7" is assigned luminance level "0"; color factor level "6" is assigned luminance level "36"; color factor level "5" is assigned luminance level "73"; color factor level "4" is assigned luminance level "109"; color factor level "3" is assigned luminance level "146"; color factor level "2" is assigned luminance level "182"; color factor level "1" is assigned luminance level "219"; and color factor level "0" is assigned luminance level "255".

The control section 40 of FIG. 1 assigns "7" to the color factor level of a subpixel corresponding to the basic portion of a character or graphics of FIG. 1, and the color factor level of a subpixel neighboring the subpixel corresponding to the basic portion of a character or graphics to any one of "1" to "6" in accordance with the correction table 32*b*. The control section 40 also assigns "0" to the color factor level of a subpixel corresponding to the background of a character or graphics.

The luminance table 32*c* is used when the display attribute of a character or graphics is "normal display (the background is displayed as being white and the character or graphics is displayed as being black)". When the display attribute of a character or graphics is "reverse display (the background is displayed as being black and the character or graphics is displayed as being white)", for example, the permutation of the luminance levels corresponding to the color factor levels "0" to "7" in the luminance table 32*c* may be reversed for each color factor R, G, and B.

Note that the display attribute of a character or graphics refers to a combination of the color of the background of the character or graphics and the color of the character or graphics. By providing an appropriate luminance table 32*c*, it is possible to display characters or graphics with any display attribute.

In FIG. 4, subpixels have 8 color factor levels (level 7 to level 0). The present invention is not so limited.

As described above, the correspondence between the color factor levels and the luminance levels is such that a plurality of color factor levels (level 7 to level 0) of a subpixel are assigned the luminance levels (0 to 255) which are substantially equally spaced. The present invention is not so limited. The color factor levels may be assigned unequally spaced luminance levels. The correspondence between the color factor levels and the luminance levels may vary among the color factors R, G, and B. For example, the correspondence between the color factor levels and the luminance levels may be appropriately determined for each of the color factors R, G, and B by taking into account the characteristics of a display device.

FIGS. 5A to 5E are each a diagram showing a different exemplary shift table 32*d* stored in the auxiliary storage device 30 of FIG. 1. In FIGS. 5A to 5E, the shift table 32*d* (321*d* to 325*d*) defines an amount of shift with which the basic portion of a character or graphics is shifted within a frame in a subpixel arrangement direction on a subpixel-by-subpixel basis. Hereinafter, it is assumed that there are three amounts of shift 0, 1, and 2, which are suitably used for the display screen 11 of the display device 10. The present invention is not so limited.

The magnitude of color noise depends on the characteristics of the display device 10, the type or number of correction patterns, the number of strokes of a character or graphics (the density of strokes), a combination of a background color and a character or graphics color, and the like. Therefore, for relaxation of color noise, shift amounts and shift tables appropriate for the causes of color noise are required.

For example, FIG. 5A shows the shift table 321*d* for determining shift amounts based on the characteristics of the display device 10 (device characteristic A, device characteristic B, device characteristic C, . . . ). There are various numbers of colors which can be displayed by the display device 10, such as 256 colors, 4096 colors, 65,000 colors, and the like. With this feature, it is possible to address the case where the basic colors R, G, and B are not uniformly exhibited, for example.

FIG. 5B shows the shift table 322*d* for determining shift amounts based on the thickness width of a character or graphics (thickness width 1, thickness width 2, thickness width 3, . . . ). For different thicknesses of characters or graphics, the color factor levels or arrangements of correction patterns need to be separately modified. Even in the case of the same background color and the same character or graphics color, the shift amount needs to be changed since visually observed color noise varies.

FIG. 5C shows the shift table 323*d* for determining the types of characters or graphics (European characters, Kanji characters, non-Kanji characters, . . . ). Different types of characters or graphics have different positions of characters or graphics relative to frames thereof, different numbers of strokes of characters or graphics, different stroke densities, or the like. Therefore, there is the case where not all of the required number of correction patterns can be provided. With the shift table 323*d*, it is possible to address such a case, for example.

FIG. 5D shows the shift table 324*d* for determining shift amounts based on a combination of a background color and a character or graphics color when browsing Web data, for example. In the shift table 324*d*, shift amounts are established for combinations of white, black, blue, red, yellow, . . .

FIG. 5E shows the shift table 325*d* for determining shift amounts based on a combination of a shift table of device characteristics and a shift table of the thickness widths of lines of characters or graphics.

Color noise is relaxed by selecting an appropriate shift amount using these tables and shifting the basic portions of characters or graphics. The shift amounts of the basic portions are information stored in these tables (values 0, 1, and 2).

Note that the shift table 32*d* is not limited to the shift tables of FIGS. 5A to 5D. The shift table 32*d* includes various other shift tables.

Figure 6:
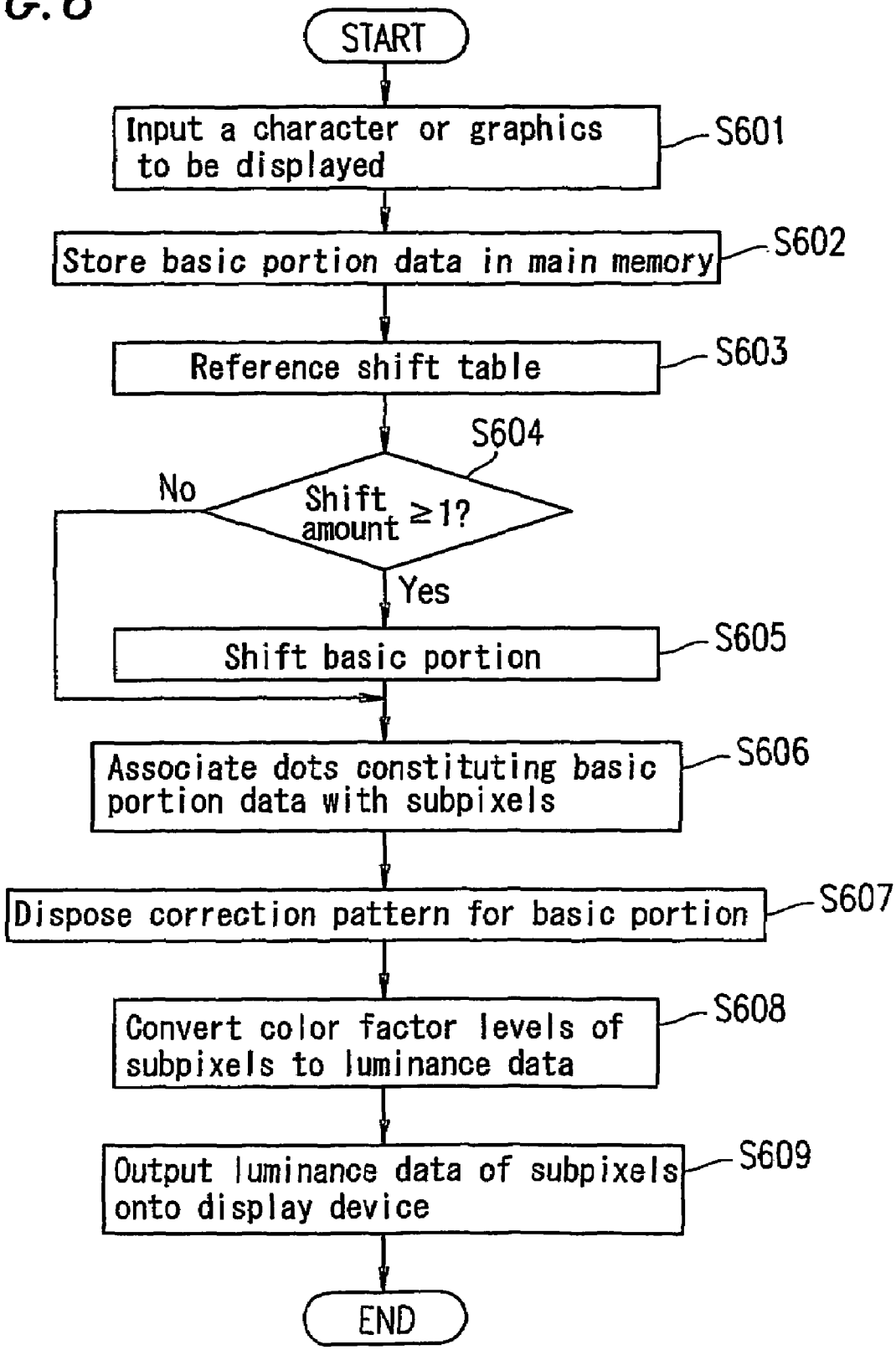
FIG. 6 is a flowchart showing a procedure for displaying characters/graphics which is described in a character/graphics display program.

FIG. 6 is a flowchart showing a procedure for displaying characters or graphics, executed by the control section 40, which is described by the character/graphics display program 31 of FIG. 1.

By executing the character/graphics display program 31 by the CPU 41 in the control section 40, characters or graphics can be displayed with high definition even when correction patterns cannot be put within a region on the display screen of the display device 10 corresponding to the frame of a character or graphics (i.e., a correction pattern extends off a region on the display screen of the display device 10 corresponding to the frame of a character or graphics).

Hereinafter, steps S601 to S609 in the character/graphics display procedure will be described.

As shown in FIG. 6, in step S601, a character or graphics to be displayed on the display screen of the display device 10 is input. In this case, for example, the identification code and size of the character or graphics are input through the input device 20.

Next, in step S602, the basic portion data of a character or graphics corresponding to the input identification code and size is obtained and stored temporarily in the main memory 42. The basic portion data is bitmap data which defines the basic portion of the character or graphics in subpixels. Dots constituting the basic portion data correspond to respective subpixels.

Figure 21:
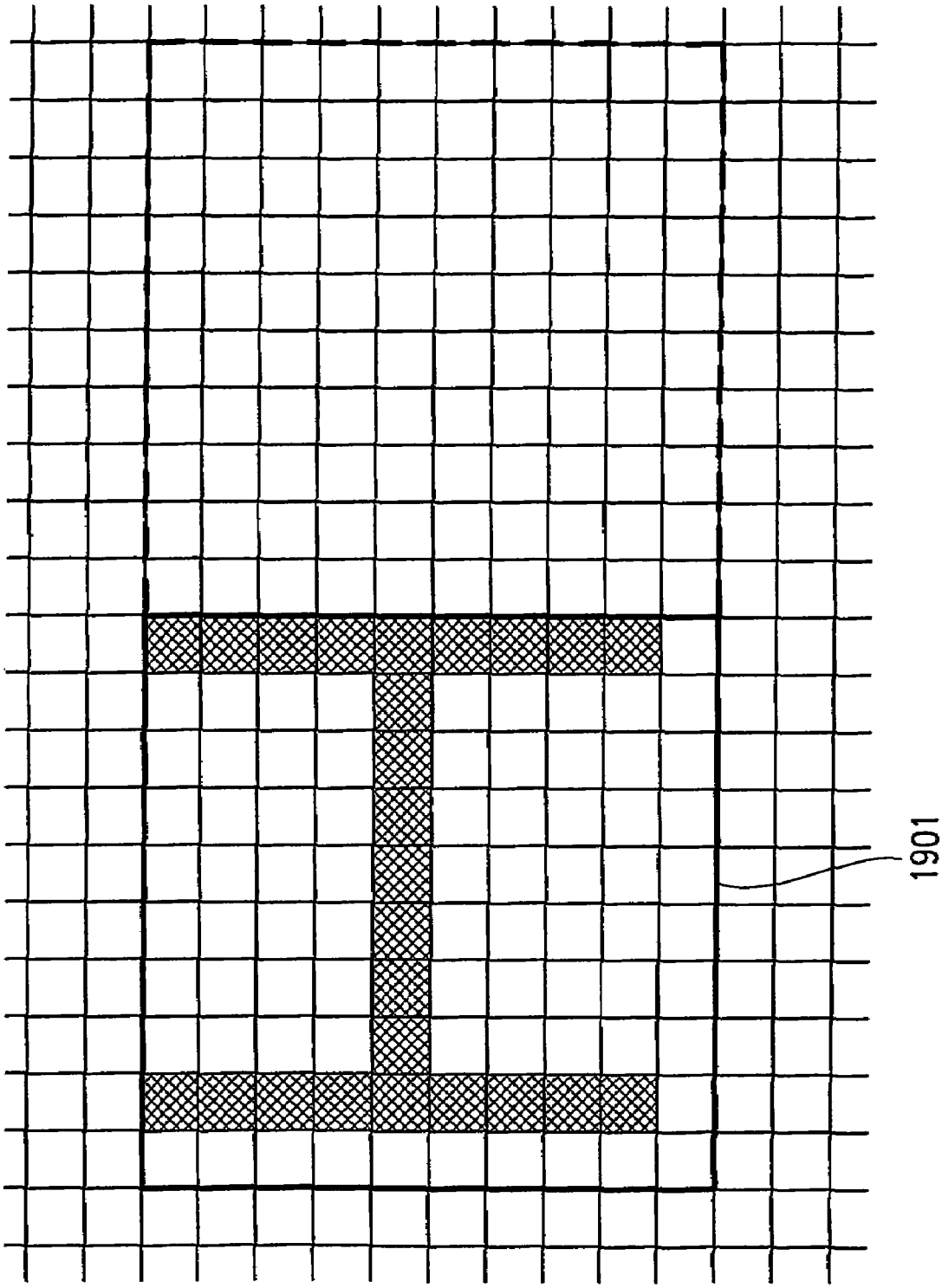
FIG. 21 is a diagram for explaining a relationship between a character and its frame.

For example, in the case where the number of pixels is 10 for each of the X and Y directions of the character or graphics input in step S601, the number of subpixels in the X direction of the character or graphics is 30 and the number of subpixels in the Y direction is 10. Since the dots constituting the basic portion data correspond to respective subpixels, the basic portion data obtained in step S602 has a size of 30 dots (X direction)×10 dots (Y direction). A region having such a size is referred to as the "frame" of a character or graphics (e.g., in FIG. 21, a region enclosed by a thick line 1901). A character or graphics is contained in the frame. Subpixels corresponding to the basic portion of a character or graphics are contained within a region corresponding to the frame on the display screen 11 of the display device 10.

The basic portion data is obtained by reading out the character/graphics data 32*a* from the auxiliary storage device 30, for example. Alternatively, as disclosed in Japanese Laid-Open Publication No. 2002-49366, the basic portion data may be generated from bitmap data representing the shape of a character or graphics in pixels. Alternatively, as disclosed in Japanese Laid-Open Publication No. 2001-100725, the basic portion data may be generated from character or graphics outline information indicating the outlines of characters or graphics or skeleton data indicating the skeleton shapes of characters or graphics.

Figure 22:
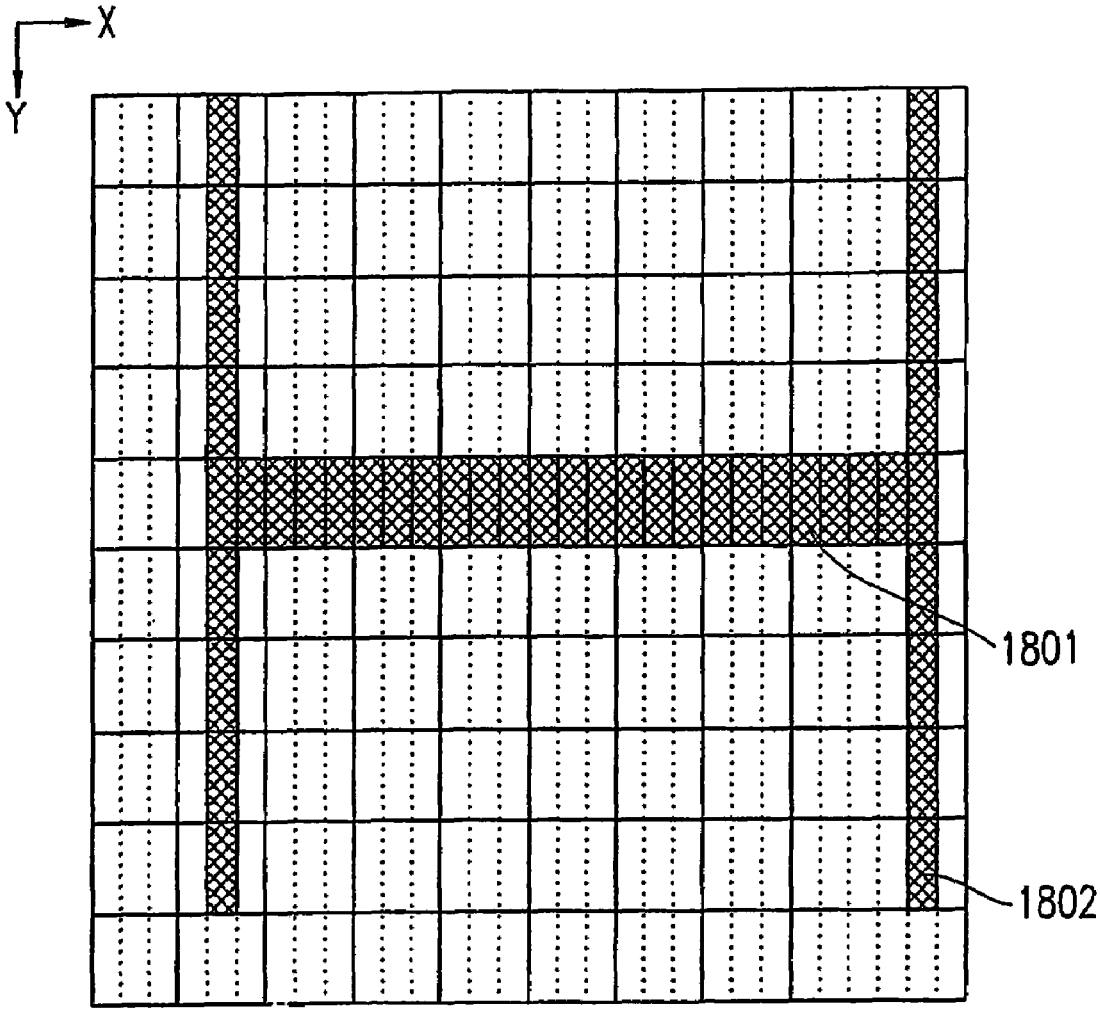
FIG. 22 CONVENTIONAL ART
FIG. 22 is a diagram for explaining the basic portion of character "H".
Figure 23:
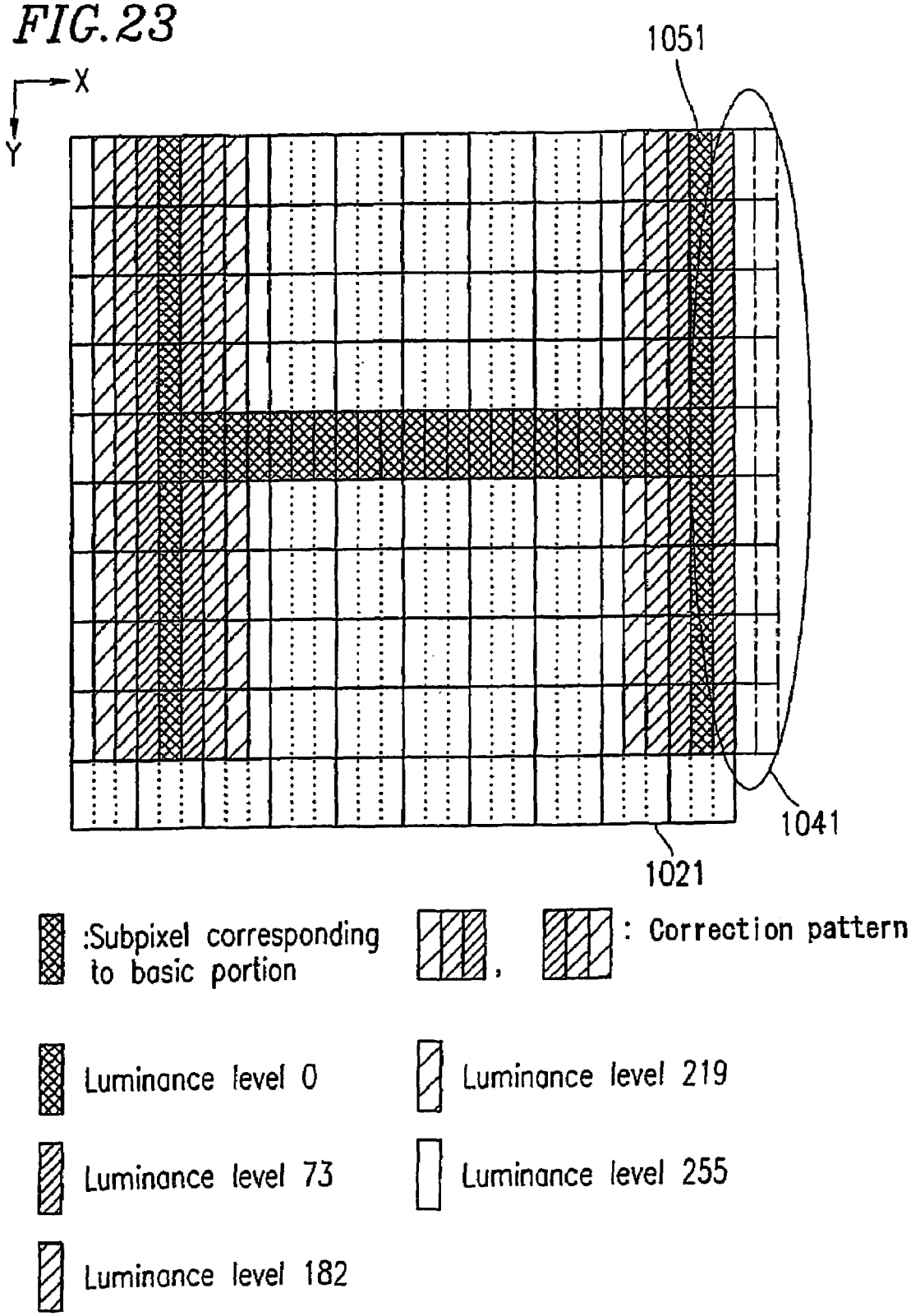
CONVENTIONAL ART FIG. 23
FIG. 23 is a diagram showing that the color factor level of a subpixel corresponding to the basic portion of character "H" is assigned a value other than a predetermined value.
Figure 24:
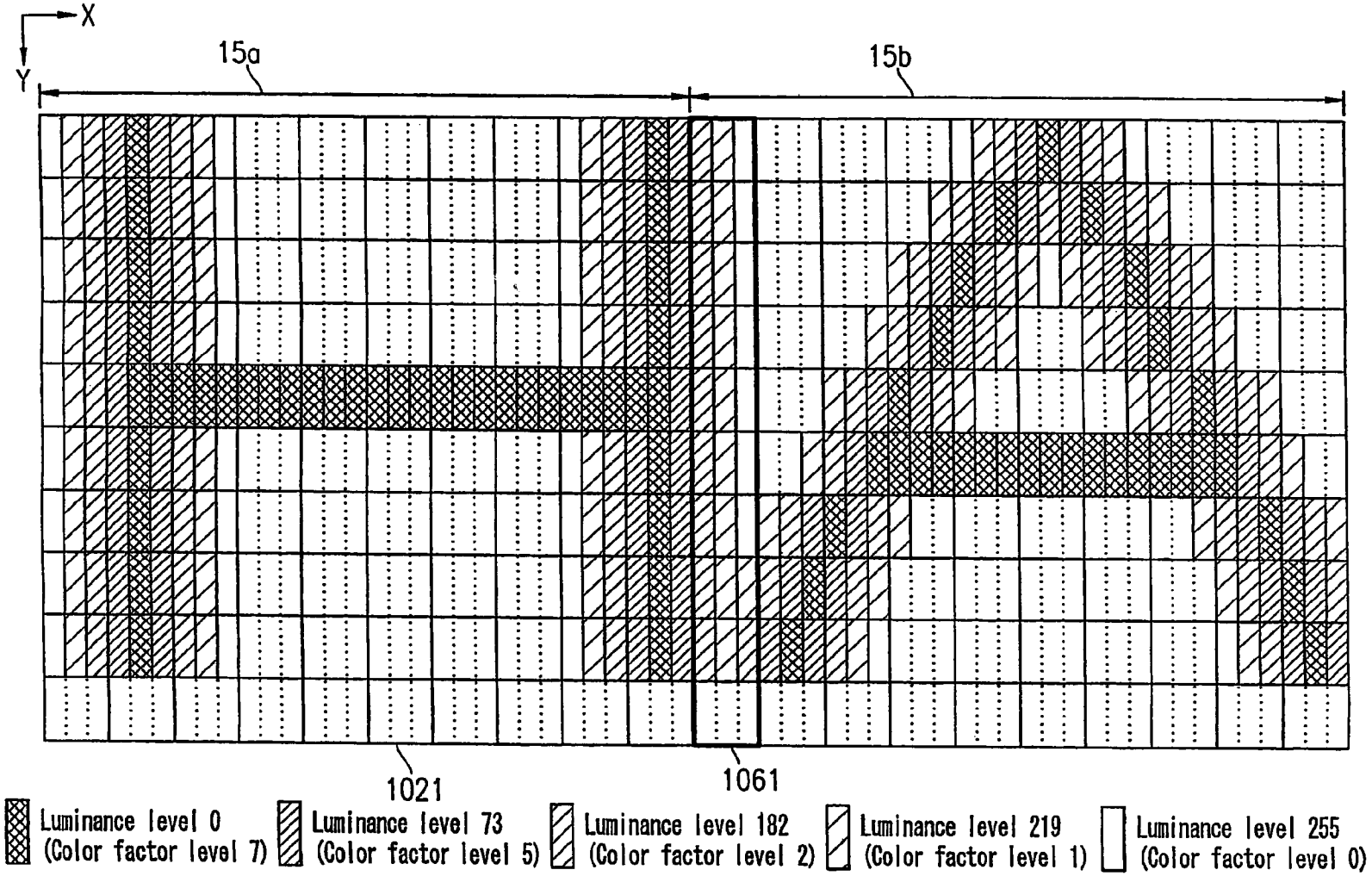
FIG. 24 CONVENTIONAL ART
FIG. 24 is a diagram for explaining a drawback of a conventional technique.

Hereinafter, it is assumed that basic portion data as shown in FIG. 22 is generated.

In step S603, the shift table 32*d* containing various data 32 is referenced. The shift amount of the basic portion of a character or graphics can be determined based on information stored in the shift table 32*d*. Now, it is assumed that the shift table 321*d* of FIG. 5A is used.

For the basic portion data of FIG. 22, there is no space on the right-hand side of the right-hand stroke (basic portion) 1802 of character "H" such that a correction pattern containing at least two subpixels is put within the frame. For this reason, the right-hand side of the stroke 1802 may have significant color noise. In this case, the shift amount is determined based on the device characteristic shown in FIG. 5A according to the display characteristic of the currently used display device 10. For example, when the display characteristic of the display device 10 is "device characteristic C" as shown in FIG. 5A, the shift amount of the basic portion of a character or graphics is 1 (on a subpixel-by-subpixel basis).

Note that even when there is no space such that a correction pattern containing at least two subpixels is put within a frame, color noise may not be visually perceived. For example, this is the case for "device characteristic B" in FIG. 5A. In this case, the shift amount of a basic portion is 0 (on a subpixel-by-subpixel basis).

Figure 7:
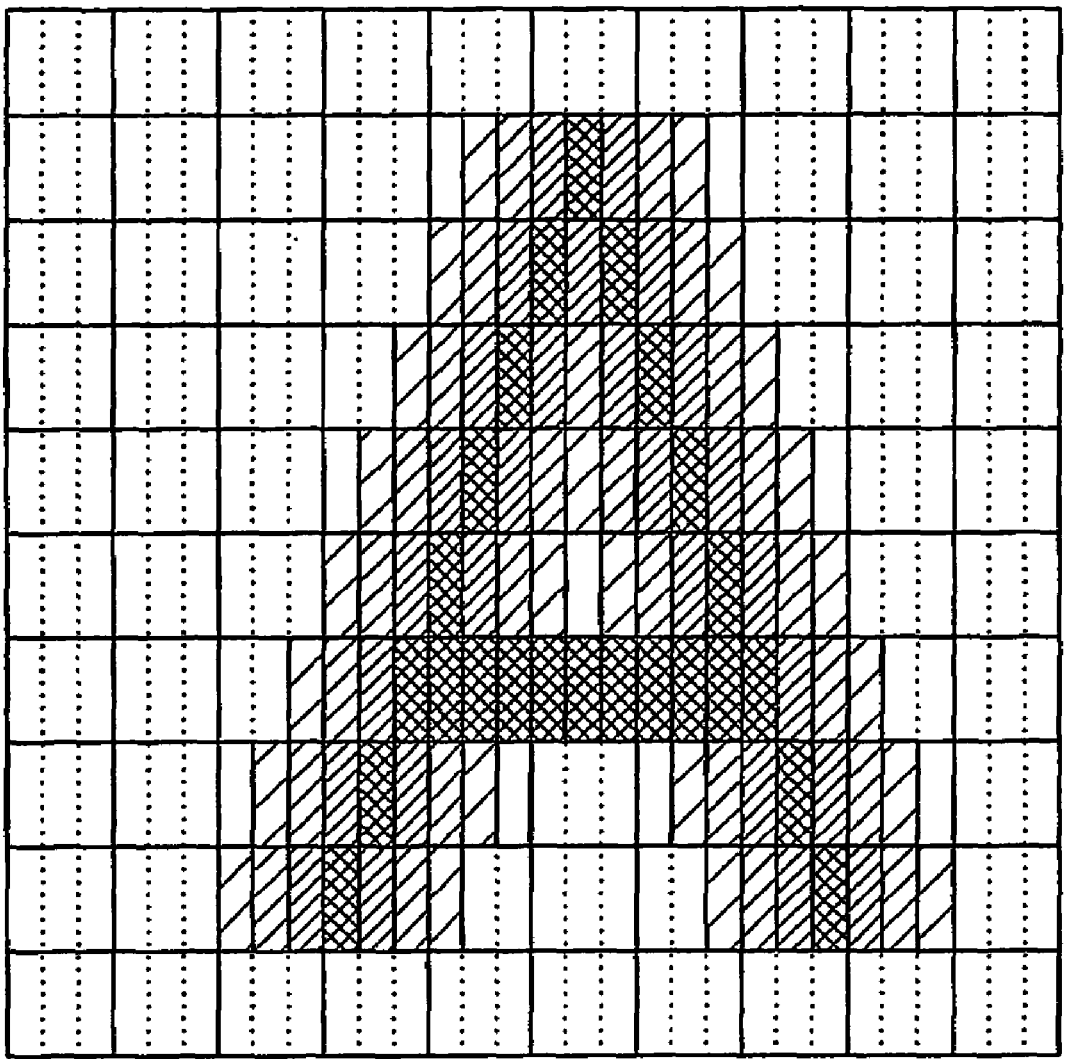
FIG. 7 is a diagram showing an example in which the shift amount of a character is 0.

The shift amount is "0" when a correction pattern can be put within the frame without shifting a character or graphics as shown in FIG. 7. Such a character or graphics includes, for example, characters having a size smaller than other characters or graphics having the same frame. In this case, step S605 is not performed, and the process goes to steps S606.

In step S604, it is determined whether or not the shift amount of the basic portion of a character or graphics defined in the shift table 321*d* is greater than or equal to "1". When the result of determination in step S604 is that the shift amount is greater than or equal to "1" (Yes), the process goes to step S605. When the result of determination in step S604 is not that the shift amount is greater than or equal to "1" (No), step S605 is not executed and the process goes to step S606.

Figure 8:
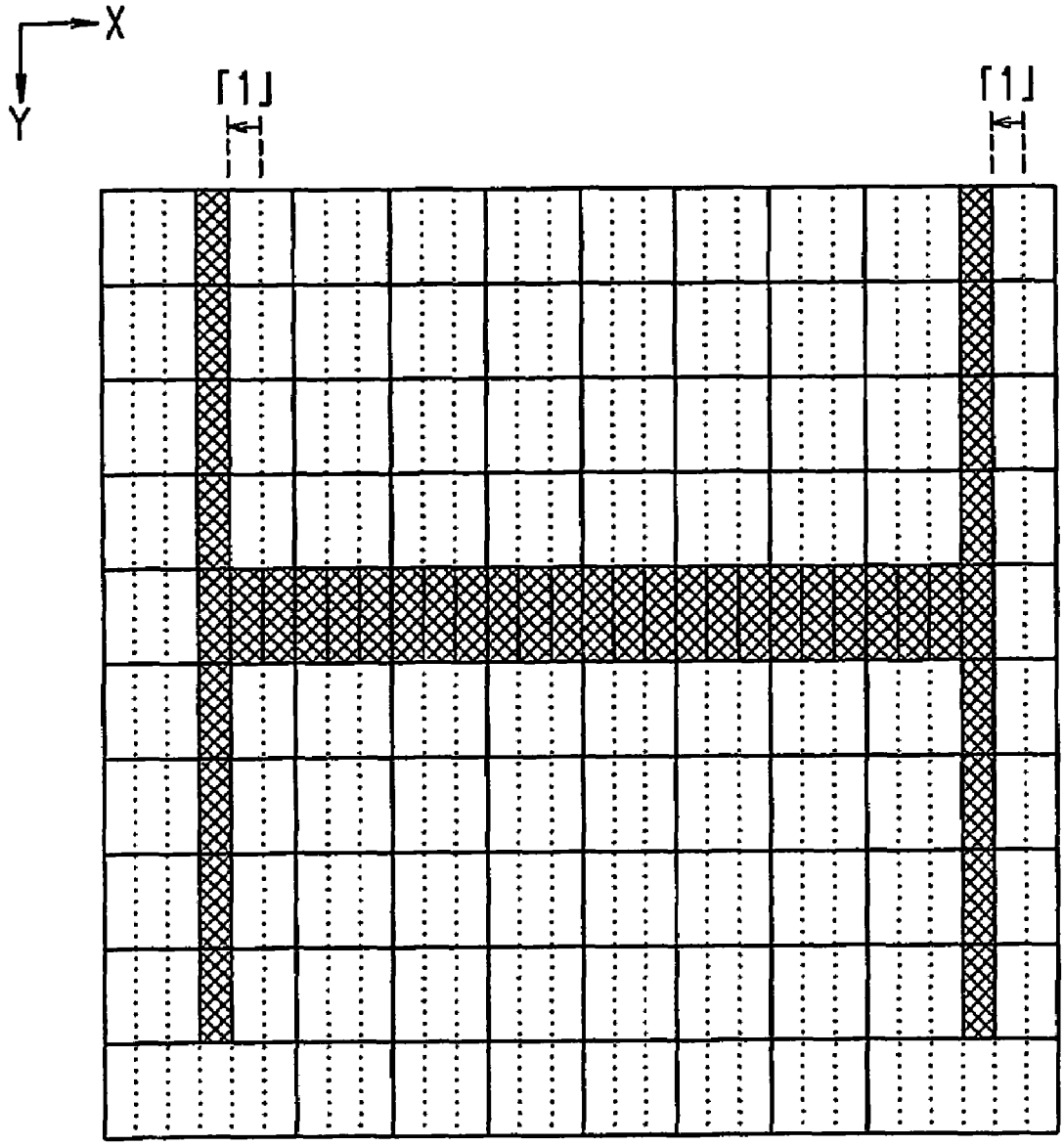
FIG. 8 is a diagram showing that the basic portion of character "H" is shifted by "1" to the left.

In step S605, based on the shift amount defined in the shift table 321*d*, the basic portion of a character or graphics is shifted. In this example, the shift amount is "1". Therefore, the basic portion of character "H" is shifted by "1" to the left from the basic portion data of FIG. 22 as shown in FIG. 8.

Figure 9:
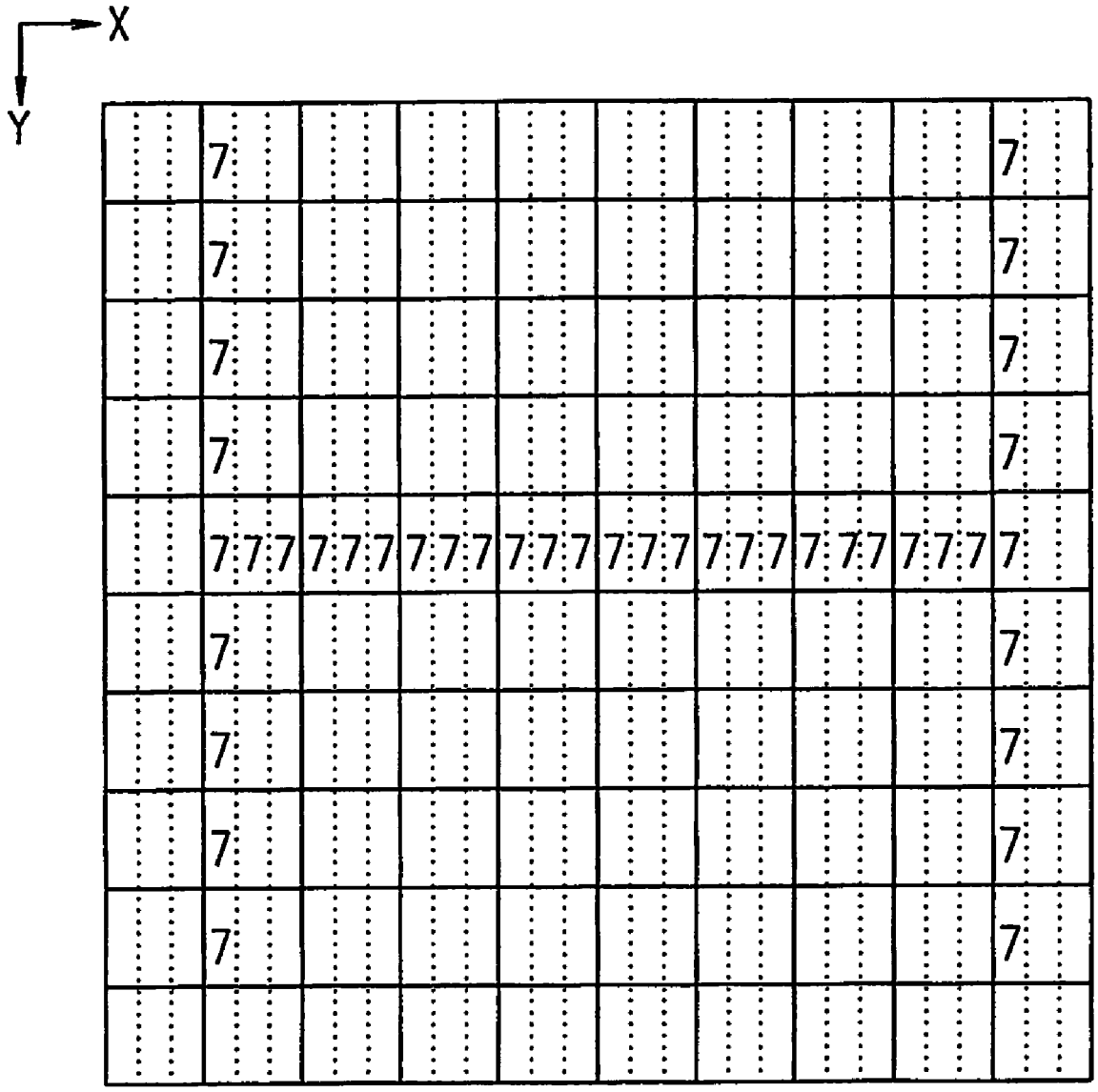
FIG. 9 is a diagram showing that the basic portion of character "H" is shifted by 1 subpixel to the left.

In step S606, each dot constituting the basic portion data is associated with a subpixel in the display device 10. This association is executed by taking into account the position of a character displayed on the display device 10. For example, when a character is displayed at the upper left corner of the display device 10, the dot at the upper left corner constituting the basic portion data is associated with a position shifted by a predetermined shift amount of subpixels from a subpixel at the upper left corner of the display device 10. A frame containing the basic portion data is associated with a region on the display screen 11. Here, the shift amount is "1", the dots constituting the basic portion data are mapped as shown in FIG. 9. The color factor levels of subpixels corresponding to the basic portion are assigned a predetermined color factor level ("7" in FIG. 9).

Figure 10:
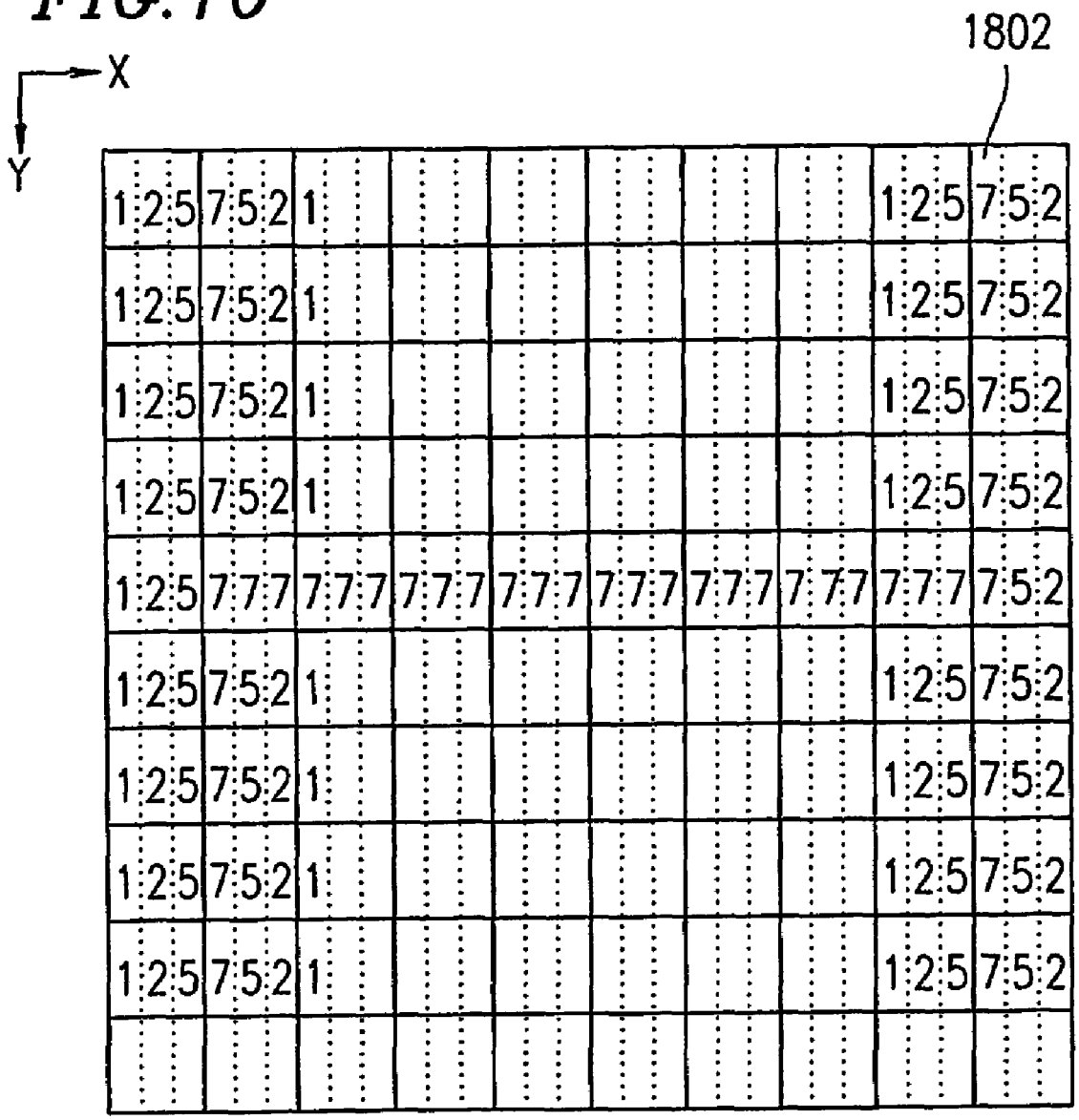
FIG. 10 is a diagram showing that subpixel neighboring a subpixel corresponding to the basic portion of character "H" of FIG. 9 are assigned values (color factor levels "5", "2", and "1") other than a predetermined value.

In step S607, a correction pattern is provided for the basic portion. The color factor levels of subpixels neighboring the subpixel corresponding to the basic portion are assigned levels lower than the predetermined color factor level. The color factor levels of the neighboring subpixels are determined based on the correction table 32*b* contained in the various data 32, and are assigned "5", "2", and "1" in order of distance from the subpixel corresponding to the basic portion, the nearest first. When the correction pattern is applied to the basic portion of FIG. 9, a correction pattern containing at least two subpixels can be disposed on the right-hand side of the right-hand stroke 1802 of character "H" as shown in FIG. 10. Thus, color noise which otherwise occurs on the right-hand side of the stroke 1802 is considerably reduced.

In step S608, the color factor levels of subpixels are converted to luminance data. This conversion is executed for each subpixel contained in a frame region corresponding to a character or graphics of the display screen 11 by referencing the luminance table 32*c* in the various data 32.

Finally, in step S609, luminance data indicating luminance levels are transferred to the display device 10. Thereby, the luminance level of the display screen 11 of the display device 10 is controlled on a subpixel-by-subpixel basis so that a character or graphics is displayed on the display screen 11.

Next, steps of a character/graphics display process in which the shift table 325*d* of FIG. 5D is employed will be described.

In step S601, the identification code and size of a character or graphics to be displayed on the display screen 11 of the display device 10 is input through the input device 20.

Next, in step S602, the basic portion data of a character or graphics corresponding to the input identification code and size is obtained and stored temporarily in the main memory 42.

In step S603, the shift table 32*d* in the various data 32 (the shift table 325*d* in FIG. 5E) is referenced. The shift amount of the basic portion of the character or graphics is determined based on information stored in the shift table 32*d*.

For the basic portion data shown in FIG. 22, significant color noise occurs as described above. In the case of different combinations of a character or graphics color and a background color, visually observed color noise varies for each color combination. In this case, based on a currently used combination of a character or graphics color and a background color, a shift amount is determined by looking up the combinations of character or graphics colors and background colors shown in FIG. 5D. For example, when the background color is "red" and the character or graphics color is "black", the shift amount of the basic portion of the character or graphics is 2 (on a subpixel-by-subpixel basis) according to FIG. 5D.

In a certain combination of a character or graphics color and a background color, color noise may not be visually perceived even when there is no space such that a correction pattern containing at least two subpixels is put within a frame as described above. For example, this is the case when a background color is "blue" and a character or graphics color is "red", and the shift amount of a basic portion is 0 (on a subpixel-by-subpixel basis).

In step S604, it is determined whether or not the shift amount of the basic portion of a character or graphics defined in the shift table 325*d* is greater than or equal to "1". When the result of determination in step S604 is that the shift amount is greater than or equal to "1" (Yes), the process goes to step S605. When the result of determination in step S604 is not that the shift amount is greater than or equal to "1" (No), step S605 is not executed and the process goes to step S606.

In step S605, based on the shift amount defined in the shift table 325*d*, the basic portion of a character or graphics is shifted. In this example, the shift amount is "2". Therefore, the basic portion of character "H" is shifted by "2" to the left from the basic portion data of FIG. 22.

Figure 11:
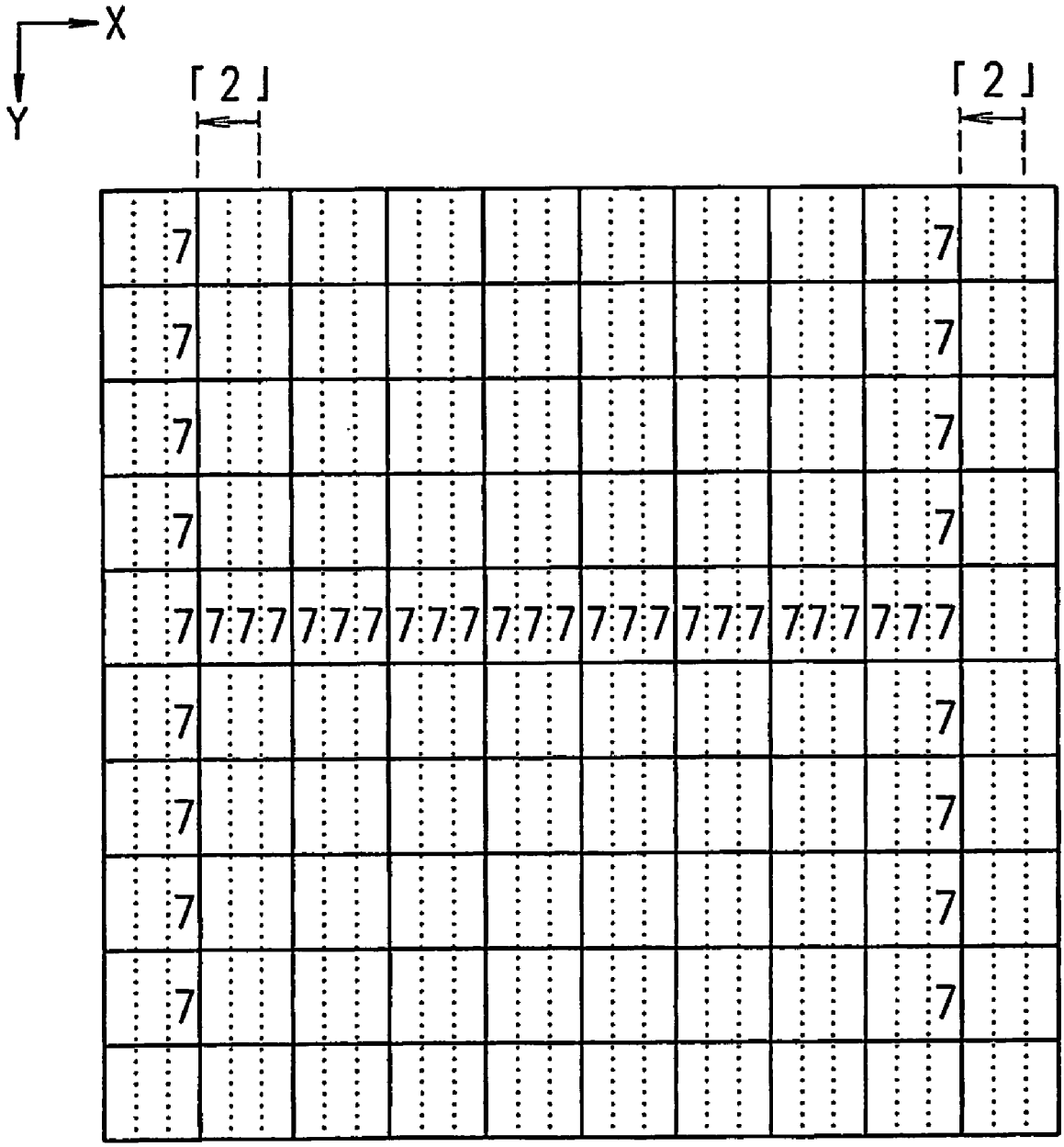
FIG. 11 is a diagram showing that the basic portion of character "H" is shifted by 2 subpixel to the left.

In step S606, dots constituting the basic portion data are associated with subpixels in the display device 10. Each dot of the basic portion data is associated with a subpixel of display device 10. Here, the shift amount is "2", the dots constituting the basic portion data are mapped as shown in FIG. 11. The color factor levels of subpixels corresponding to the basic portion are assigned a predetermined color factor level ("7" in FIG. 11).

Figure 12:
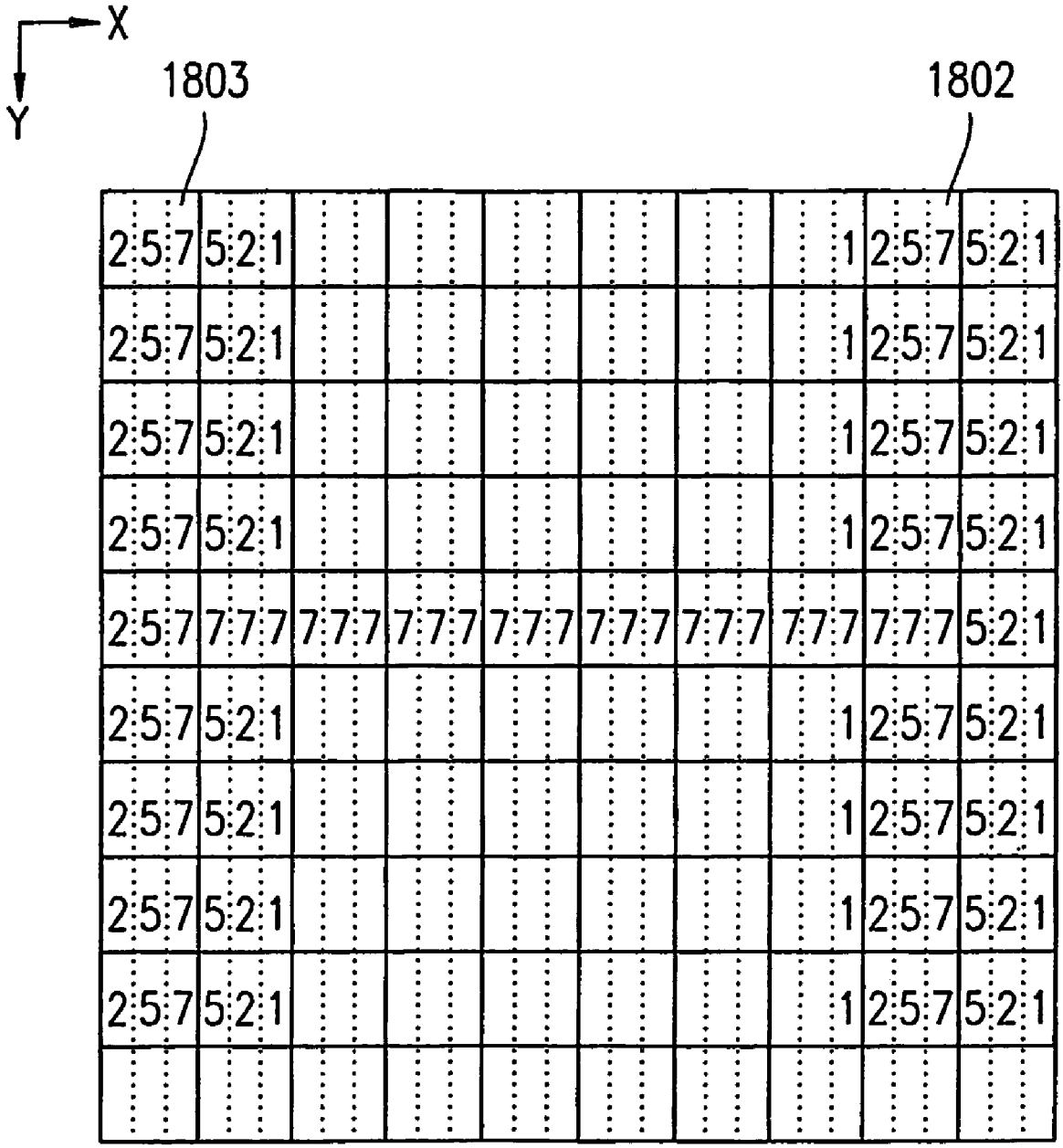
FIG. 12 is a diagram showing that subpixel neighboring a subpixel corresponding to the basic portion of character "H" of FIG. 11 are assigned values (color factor levels "5", "2", and "1") other than a predetermined value.
Figure 13:
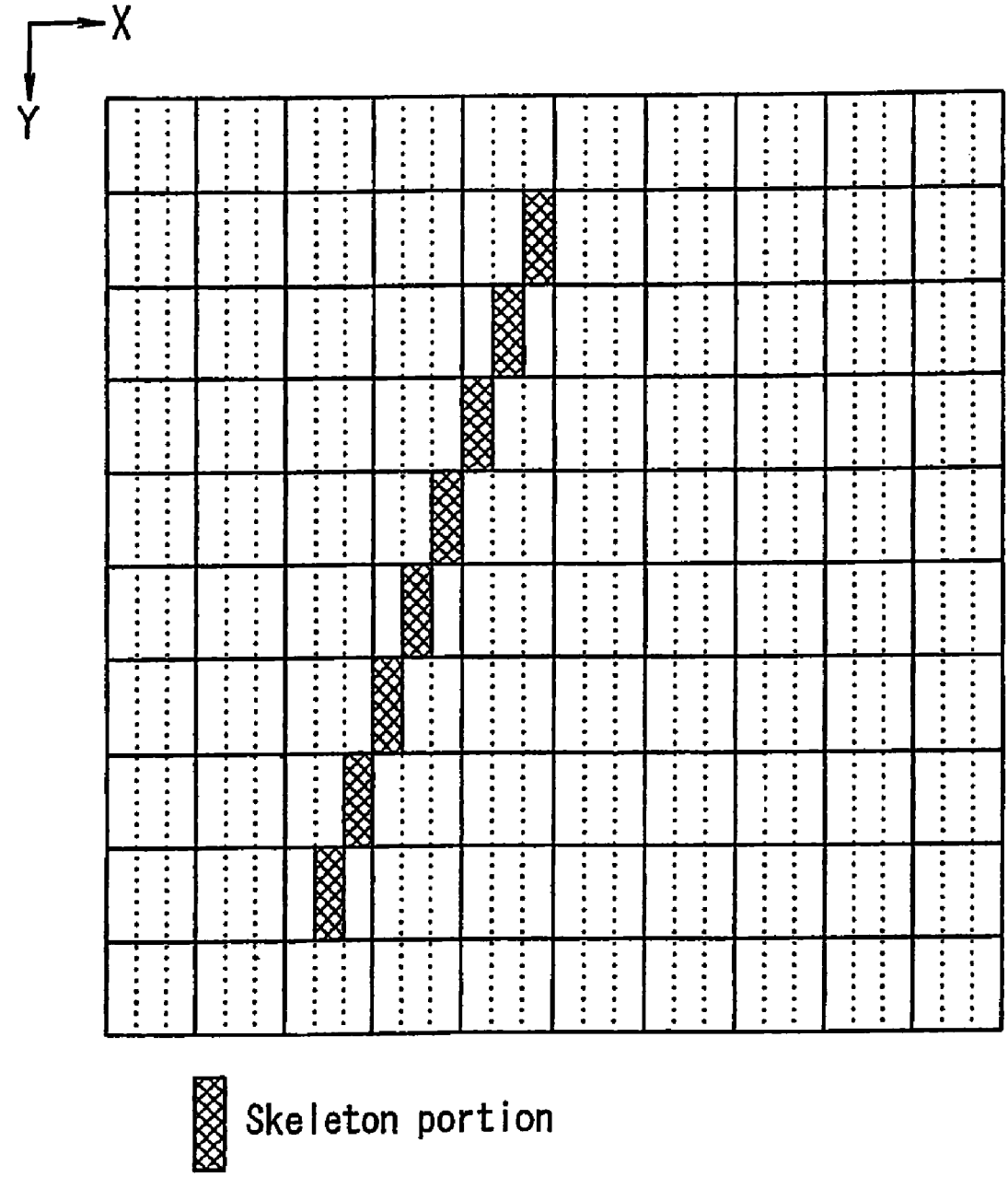
FIG. 13 CONVENTIONAL ART
FIG. 13 is a diagram showing a conventional technique disclosed in Japanese Laid-Open Publication No. 2001-100725, in which the intensity of the color factor level of a subpixel corresponding to the basic portion of character "/" (slash) is assigned a predetermined value.
Figure 14:
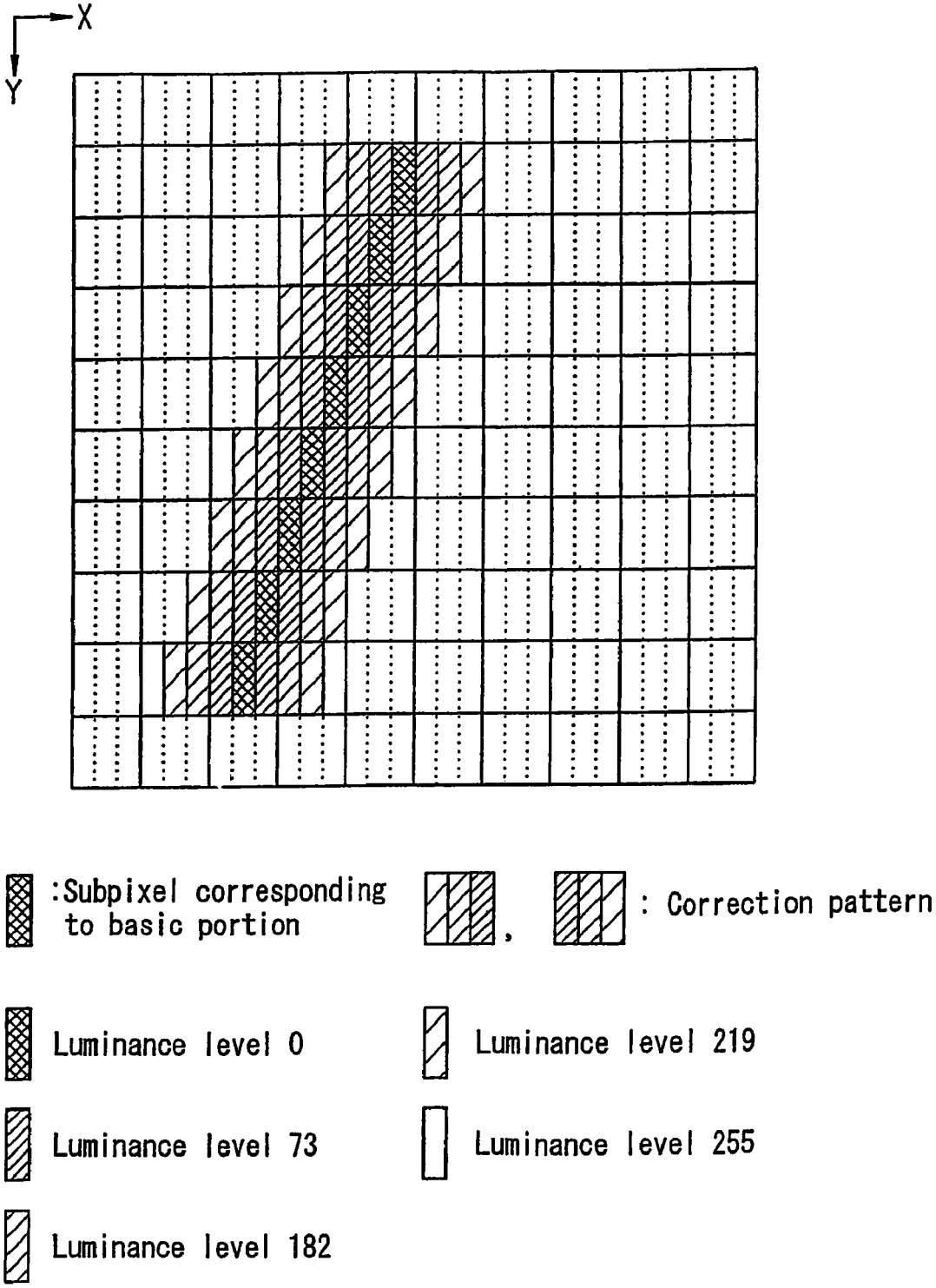
FIG. 14 CONVENTIONAL ART
FIG. 14 is a diagram showing a conventional technique disclosed in Japanese Laid-Open Publication No. 2001-100725, in which the intensities of the color factor levels of subpixels neighboring the subpixel corresponding to the basic portion of character "/" (slash) are assigned values other than the predetermined value.
Figure 15:
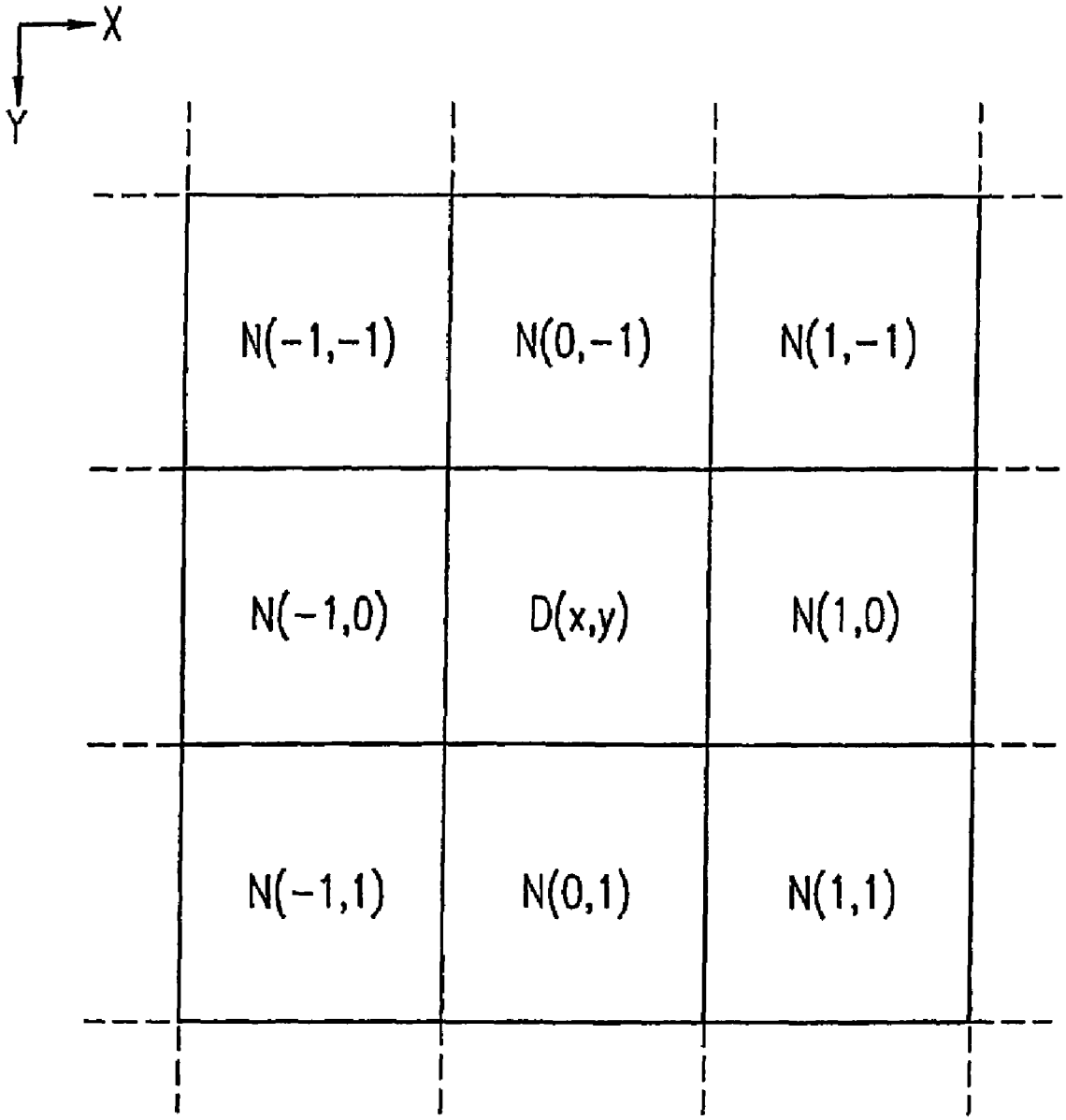
FIG. 15 CONVENTIONAL ART
FIG. 15 is a diagram showing a part of bitmap data representing graphics.
Figure 16:
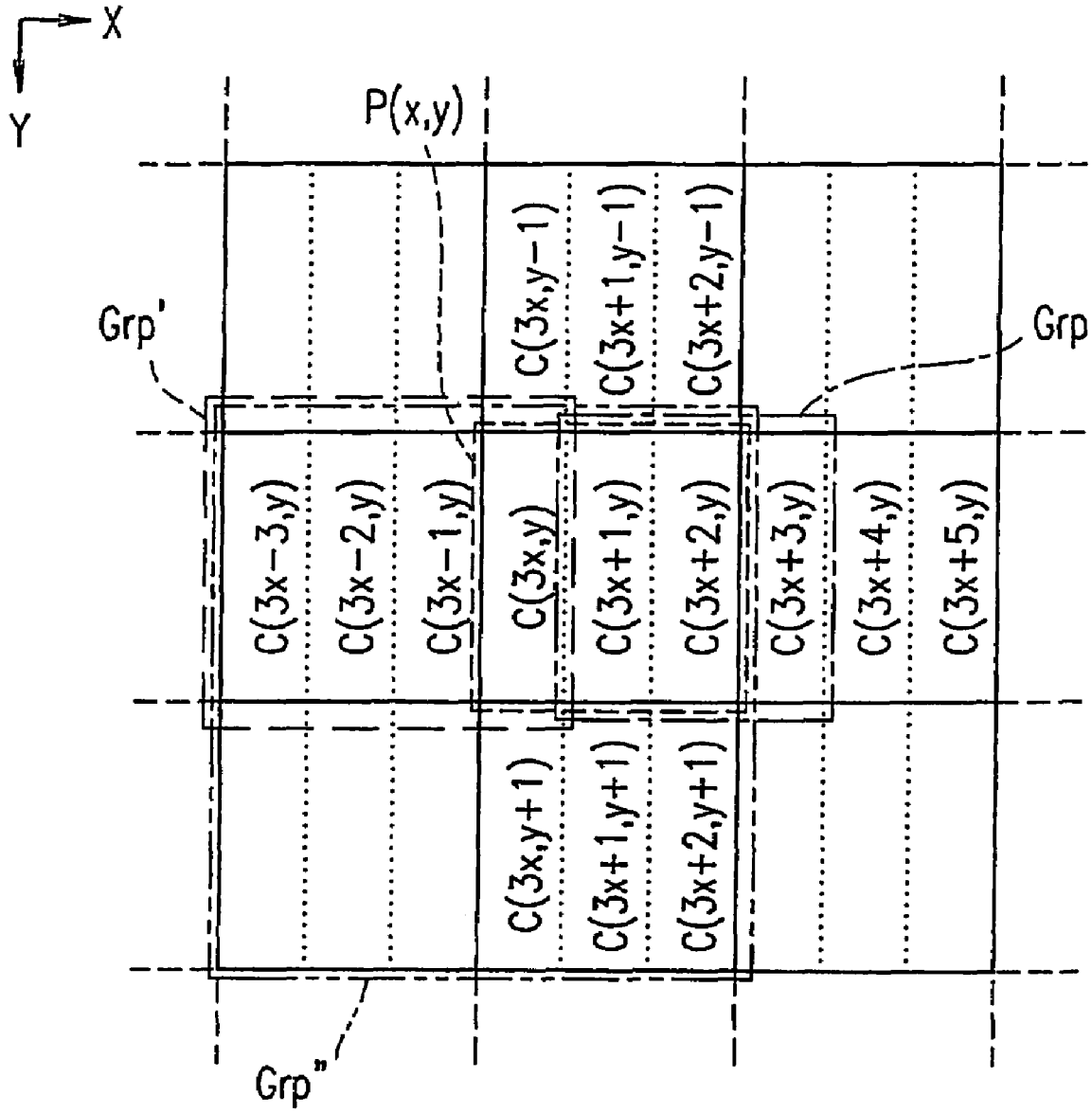
FIG. 16 CONVENTIONAL ART
FIG. 16 is a diagram showing a part of a display screen of a display device.
Figure 17A:
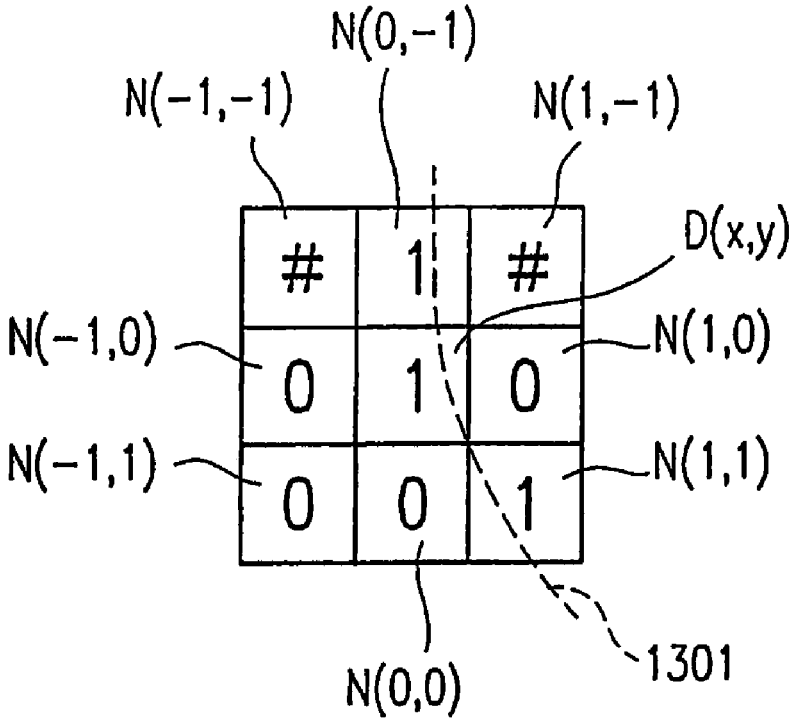
CONVENTIONAL ART FIG. 17A
FIG. 17A is a diagram showing exemplary 8 neighboring bits for bit D(x, y) of interest in bitmap data.
Figure 17B:
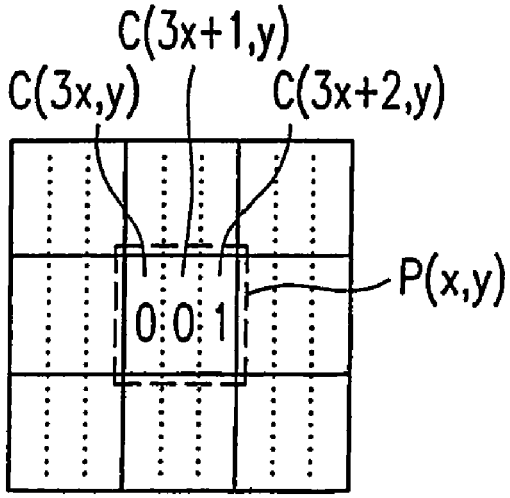
CONVENTIONAL ART FIG. 17B
FIG. 17B is a diagram showing subpixels defined by a basic portion definition rule, where the 8 neighboring bits for bit D(x, y) has values as shown in FIG. 17A.
Figure 18A:
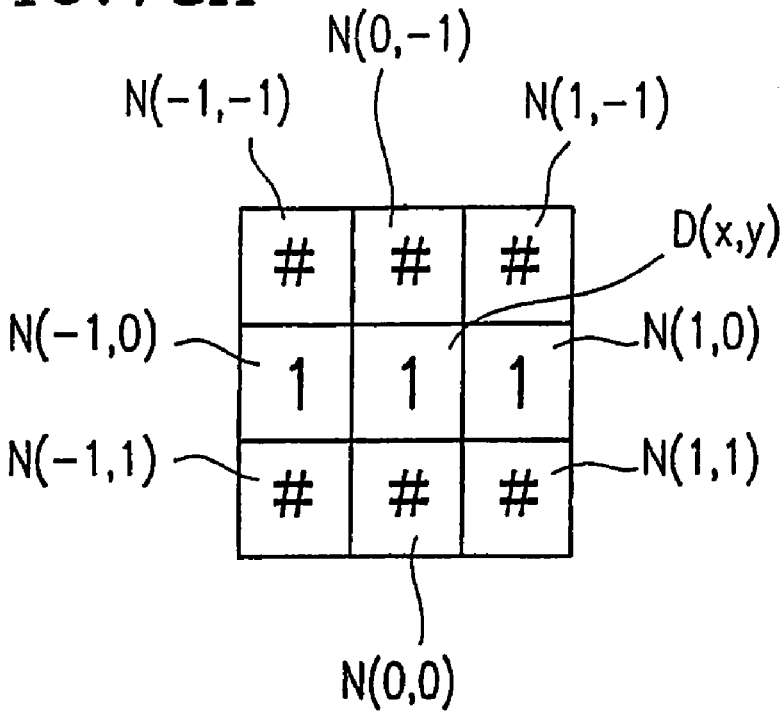
CONVENTIONAL ART FIG. 18A
FIG. 18A is a diagram showing another exemplary set of 8 neighboring bits for bit D(x, y) of interest in bitmap data.
Figure 18B:
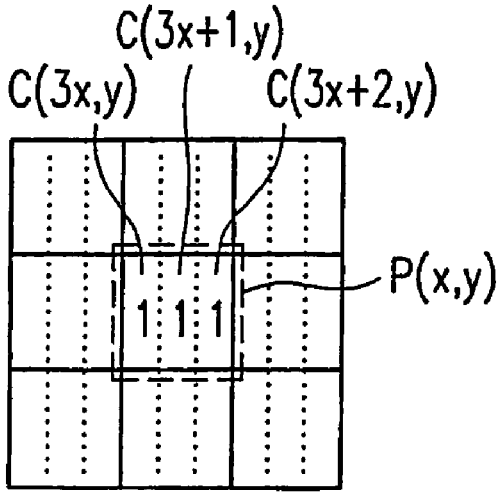
CONVENTIONAL ART FIG. 18B
FIG. 18B is a diagram showing subpixels defined by a basic portion definition rule, where the 8 neighboring bits for bit D(x, y) has values as shown in FIG. 18A.
Figure 19A:
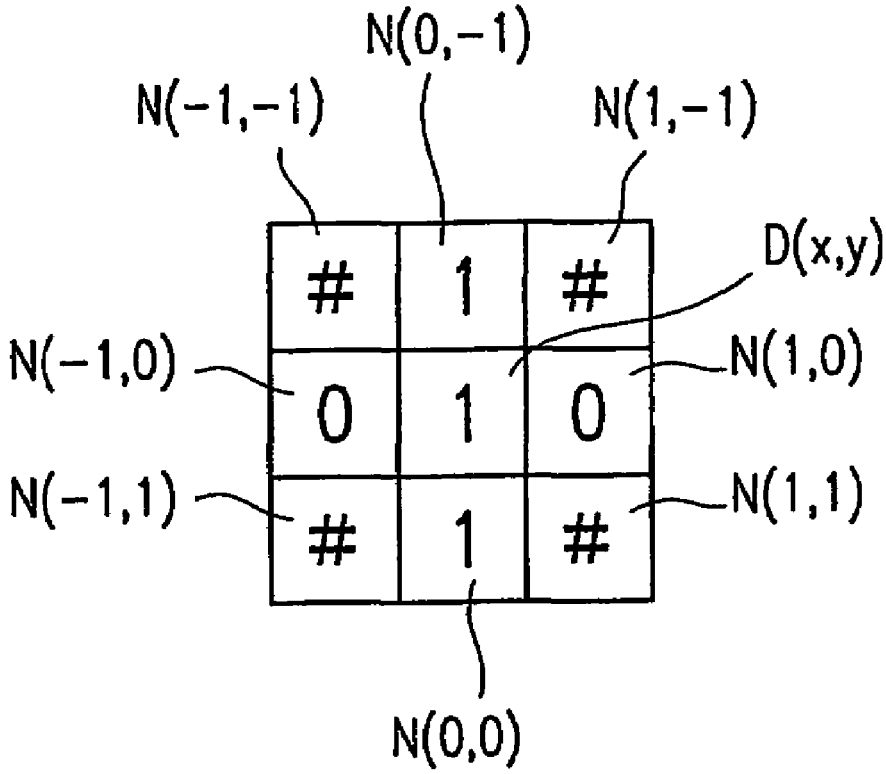
FIG. 19A is a diagram showing another exemplary set of 8 neighboring bits for bit D(x, y) of interest in bitmap data.
Figure 19B:
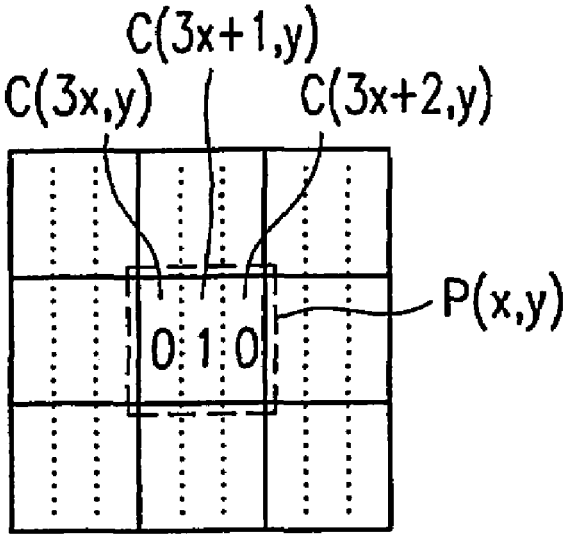
FIG. 19B is a diagram showing subpixels defined by a basic portion definition rule, where the 8 neighboring bits for bit D(x, y) has values as shown in FIG. 19A.
Figure 20:
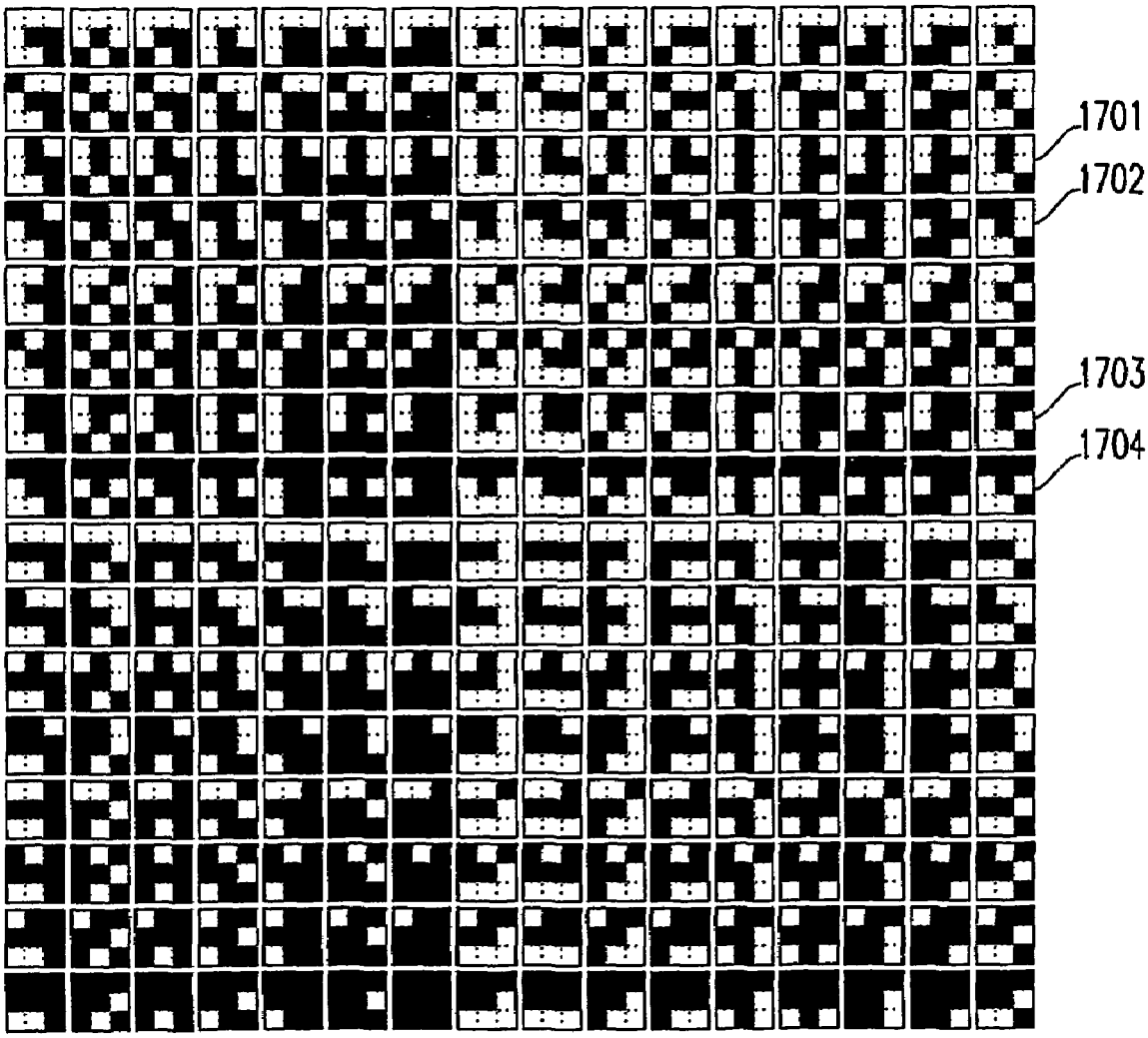
FIG. 20 is a diagram showing all combinations of "1" or "0" of 8 neighboring bits.

In step S607, a correction pattern is provided for the basic portion. The color factor levels of subpixels neighboring the subpixel corresponding to the basic portion are assigned levels lower than the predetermined color factor level. The color factor levels of the neighboring subpixels are determined based on the correction table 32*b* contained in the various data 32, and are assigned "5", "2", and "1" in order of distance from the subpixel corresponding to the basic portion, the nearest first. When the correction pattern is applied to the basic portion of FIG. 11, a correction pattern containing at least two subpixels can be disposed on the right-hand side of the right-hand stroke 1802 of character "H" as shown in FIG. 12. Thus, color noise which otherwise occurs on the right-hand side of the stroke 1802 is considerably reduced.

Note that when the shift amount of the basic portion is assigned "2", a portion of the correction pattern cannot be disposed on the left-hand side of the left-hand strode 1803 of character "H". Nevertheless, "at least two subpixels of a correction pattern can be disposed", which is required for reduction of color noise. Therefore, significant color noise does not occur.

Further, in step S608, the color factor levels of subpixels are converted to luminance levels. This conversion is executed for each subpixel contained in a frame region corresponding to a character or graphics of the display screen 11 by referencing the luminance table 32*c* in the various data 32.

Finally, in step S609, luminance data indicating luminance levels are transferred to the display device 10. Thereby, the luminance level of the display screen 11 of the display device 10 is controlled on a subpixel-by-subpixel basis so that a character or graphics is displayed on the display screen 11.

Note that in this example, a character/graphics is displayed by referencing only one of the shift tables. For example, a shift table obtained by combining shift tables as in shift table 325*d* of FIG. 5E, may be used to obtain a shift amount of the basic portion of a character or graphics.

In this example, the English alphabet is displayed on the display screen 11 of the display device 10. The present invention is not so limited. The present invention can be applied to any other language characters (e.g., Japanese language characters, Chinese language characters, English language characters, Korean language characters, and the like). The present invention is not limited to characters and can be applied to symbol information, such as picture characters, graphics, signs, and the like.

In this example, data after shifting a basic portion in step S605 or data after disposing a correction pattern for a basic portion in step S607 may be stored in a recording medium, such as ROM, FD, CD or the like so that a character or graphics can be displayed on an apparatus other than the display apparatus 1. As the ROM, for example, mask ROM, EPROM, EEPROM, flash ROM, and the like can be employed. In the case of use of ROM, various processed can be easily implemented by changing the ROM.

In this example, data after shifting a basic portion in step S605 or data after disposing a correction pattern for a basic portion in step S607 may be stored in a recording medium in a storage apparatus capable of storing data, such as hard disk, CD-ROM, MO, MD, DVD, IC card, optical card, flash memory or the like so that a character or graphics can be displayed on an apparatus other than the display apparatus 1.

The above-described readable recording medium may be a medium for unfixedly carrying programs or data, such as a communication medium used to carry programs or data over a communication network, other than media for fixedly carrying programs or data, such as storage devices (the above-described disks or cards), semiconductor memories, and the like. When the display apparatus 1 is an information apparatus provided with means for connecting a communication line including the Internet, at least part of data may be downloaded from the communication line.

In this example, color factor levels in a correction pattern are provided on each lateral side of the skeleton portion and are assigned values which are smaller than the color factor level of the skeleton portion of character or graphics information, the values being stepwise decreased. The present invention is not so limited. Alternatively, color factor levels in a correction pattern are provided on a single lateral side of the skeleton portion and are assigned values which are smaller than the color factor level of the skeleton portion of character or graphics information, the values being stepwise decreased. In addition to or alternative to this technique, color factor levels in a correction pattern are provided on each or a single vertical side of the skeleton portion and are assigned values which are smaller than the color factor level of the skeleton portion of character or graphics information, the values being stepwise decreased. Therefore, in the present invention, color factor levels are provided outside the skeleton portion of character or graphics information (each or a single lateral side and/or each or a single vertical side) and are assigned values smaller than the color factor level of the skeleton portion, the values being stepwise decreased. Specifically, the direction of arrangement of the subpixels 12R, 12G, and 12B is not limited to the direction indicated in FIG. 2 (X direction). In addition to or alternative to the X direction, the direction of arrangement of the subpixel 12R, 12G, and 12B may be the Y direction. For example, a correction pattern defined in a correction table may be provided in the vicinity of the basic portion (skeleton portion) of a subpixel corresponding to a character or graphics in a vertical direction (Y direction and/or −(minus) Y direction) and the color factor levels of subpixels are assigned, for example, "5", "2", and "1" in order of distance from the basic portion (skeleton portion) of the character or graphics, the nearest first.

INDUSTRIAL APPLICABILITY

As described above, according to the present invention, a control section is used to shift the center of the skeleton portion of character or graphics information to the center of a frame. Specifically, character or graphics information is shifted within the frame in a subpixel arrangement direction on a subpixel-by-subpixel basis. The skeleton portion (basic portion) is shifted so that a correction pattern having at least two subpixels (having color factor levels stepwise lower than a predetermined color factor level) can be provided inwardly from an end of the frame. Thereafter, at least a subpixel corresponding to the skeleton portion (basic portion) of character or graphics information is assigned a predetermined color factor level. Neighboring subpixels outside that subpixel are assigned color factor levels stepwise lower than the predetermined color factor level. In this manner, character or graphics information is displayed on the display screen of a display device. With such a simple procedure of shifting character or graphics information, characters or graphics can be displayed with high definition and without color noise even when correction patterns cannot be otherwise put within a region on the display screen corresponding to the frame of the character or graphics (i.e., a correction pattern extending off a region on the display screen of a display device corresponding to the frame of the character or graphics can be shifted to be put within the region).

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

The invention claimed is:

1. A display apparatus, comprising:

a control section for controlling display on a display screen so that portions neighboring a skeleton portion of symbol information are assigned color factor levels, wherein the symbol information is displayed in frames having a predetermined size and the color factor levels are stepwise lower than a color factor level of the skeleton portion, wherein the control section has a skeleton portion shifting section capable of controlling shift of a center of the skeleton portion toward a center of the frame in a predetermined direction on the display screen.

2. A display apparatus according to claim 1, wherein the control section comprises:

a skeleton portion color factor level assigning section for assigning a predetermined color factor level to a subpixel corresponding to the skeleton portion of the symbol information after the skeleton portion has been shifted;

an outside color factor level assigning section for assigning at least one color factor level stepwise lower than the predetermined color factor level of the subpixel corresponding to the skeleton portion to at least one neighboring subpixel outside the skeleton portion; and a display control section for displaying the symbol information assigned the color factor levels on the display screen.

3. A display apparatus according to claim 1, wherein a plurality of pixels are provided on the display screen, each pixel having a plurality of subpixels arranged in a predetermined direction, and the skeleton portion shifting section is capable of shifting the skeleton portion of the symbol information in a subpixel arrangement direction within the frame on a subpixel-by-subpixel basis.

4. A display apparatus according to claim 3, wherein the skeleton portion shifting section is capable of shifting the skeleton portion of the frame so that at least two subpixels having a color factor level lower than the color factor level of the skeleton portion are disposed inwardly from an end of the frame.

5. A display apparatus according to claim 1, wherein the symbol information is at least one of character information, graphics information, picture character information, and sign information.

6. A display apparatus according to claim 2, wherein the symbol information is at least one of character information, graphics information, picture character information, and sign information.

7. A display apparatus according to claim 3, wherein the skeleton portion of the symbol information is defined by bitmap data.

8. A display apparatus according to claim 3, wherein the skeleton portion of the symbol information is defined in subpixels.

9. A display apparatus according to claim 3, wherein the skeleton portion shifting section is capable of shifting the skeleton portion of the symbol information in a subpixel arrangement direction within the frame by one or two pixels.

10. A display apparatus according to claim 3, wherein the display apparatus has a shift table storing shift information for defining a shift amount of the skeleton portion of the symbol information, and the skeleton portion shifting section is capable of determining the shift amount of the skeleton by referencing the shift table.

11. A display apparatus according to claim 9, wherein the display apparatus has a shift table storing shift information for defining a shift amount of the skeleton portion of the symbol information, and the skeleton portion shifting section is capable of determining the shift amount of the skeleton by referencing the shift table.

12. A display apparatus according to claim 10, wherein the display apparatus has a plurality of shift tables, and the skeleton portion shifting section is capable of changing the shift amount of the skeleton by selecting and referencing at least one of the plurality of shift tables.

13. A display apparatus according to claim 11, wherein the display apparatus has a plurality of shift tables, and the skeleton portion shifting section is capable of changing the shift amount of the skeleton by selecting and referencing at least one of the plurality of shift tables.

14. A display apparatus according to claim 3, wherein the display apparatus has a recording section for storing information on a result of shifting the skeleton portion in the subpixel arrangement direction within the frame on a subpixel-by-subpixel basis.

15. An information display method for controlling and displaying symbol information on a display screen, wherein a plurality of pixels are provided in a frame having a predetermined size on the display screen, each pixel contains a plurality of subpixels arranged in a predetermined direction, and at least one subpixel outside a skeleton portion of the symbol information is assigned a color factor level stepwise lower than a color factor level, the method comprising the steps of:

shifting the skeleton portion of the symbol information in a subpixel arrangement direction within the frame on a subpixel-by-subpixel basis; and assigning a predetermined color factor level to a subpixel corresponding to the skeleton portion of the symbol information, and assigning at least one color factor level stepwise lower than the predetermined color factor level of the subpixel corresponding to the skeleton portion to at least one neighboring subpixel outside the skeleton portion.

16. An information display method according to claim 15, wherein the symbol information is at least one of character information, graphics information, picture character information, and sign information.

17. A computer program product carrying a computer program embodied in a computer readable medium adapted to perform the information display method for controlling and displaying symbol information on a display screen according to claim 15.

18. An information apparatus, comprising a display apparatus 10 according to claim 1.

19. An information apparatus, comprising a display apparatus according to claim 2.

* * * * *